US007114790B2

(12) United States Patent
Seki et al.

(10) Patent No.: US 7,114,790 B2
(45) Date of Patent: Oct. 3, 2006

(54) PRINTING APPARATUS AND DOT POSITION ADJUSTING METHOD

(75) Inventors: Satoshi Seki, Kanagawa (JP); Naoji Otsuka, Kanagawa (JP); Kiichiro Takahashi, Kanagawa (JP); Osamu Iwasaki, Tokyo (JP); Minoru Teshigawara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 10/925,036

(22) Filed: Aug. 25, 2004

(65) Prior Publication Data

US 2005/0046657 A1 Mar. 3, 2005

(30) Foreign Application Priority Data

Aug. 29, 2003 (JP) ..... 2003-308004

(51) Int. Cl.
*B41J 29/00* (2006.01)

(52) U.S. Cl. ..... 347/5; 347/19

(58) Field of Classification Search ..... 347/5, 347/19

See application file for complete search history.

(56) References Cited

U.S. PATENT DOCUMENTS 6,109,722 A * 8/2000 Underwood et al. ..... 347/19
6,168,261 B1 1/2001 Miyake et al.
6,371,592 B1 4/2002 Otsuka et al.
6,454,390 B1 9/2002 Takahashi et al.
6,474,767 B1 11/2002 Teshigawara et al.
2005/0052481 A1 3/2005 Takahashi et al.
2005/0052494 A1 3/2005 Takahashi et al.
2005/0057600 A1 3/2005 Teshigawara et al.

FOREIGN PATENT DOCUMENTS

JP 11-291470 10/1999
JP 11-291553 10/1999

* cited by examiner

*Primary Examiner*—Huan Tran
(74) *Attorney, Agent, or Firm*—Fitzpatrick, Cella, Harper & Scinto

(57) ABSTRACT

A printing apparatus and a print position aligning method are provided which can execute a dot position adjust value calculation mode normally and smoothly without requiring the user to make decisions or adjustments. A test pattern to check the width of a print medium is printed and is detected by an optical sensor to decide whether or not a dot position adjustment pattern can be printed. Before the dot position adjustment pattern is printed, a decision is made as to whether the print medium supplied is appropriate or not. If the print medium supplied is smaller than a size specified for the dot position adjust value calculation processing, the print medium is discharged without being printed with the dot position adjustment pattern. This eliminates a possibility of a wasteful consumption of print mediums and of contaminating the interior of the printing apparatus.

11 Claims, 15 Drawing Sheets

PRINTING APPARATUS AND DOT POSITION ADJUSTING METHOD

BACKGROUND OF THE INVENTION

1. Field of the Invention

The present invention relates to a printing apparatus to form an image by printing a colorant on a print medium by a dot matrix printing method and also to a dot position adjusting method for the printing apparatus.

2. Description of the Related Art

As personal computers and digital cameras have come into widespread use in recent years, a variety of printing apparatus to print information output from these devices are being developed. At the same time efforts to enhance a print speed and a print quality of these apparatus are rapidly gaining momentum. A serial printer of an ink jet system using the dot matrix printing method in particular is drawing attention as a printing apparatus capable of producing a high quality printed output at low cost and high speed. Such an ink jet printing apparatus uses, for example, a bidirectional printing method as a technology for printing at faster speed. As a technology for providing a higher print quality, for instance, a multi-pass printing method is available.

In an ink jet printing apparatus a quality image cannot be obtained unless a plurality of ink droplets land at correct positions on a print medium forming dots in a correct, dot-to-dot relationship. However, various errors inherent in the printing apparatus and errors among individual print scans performed during the bidirectional printing or multi-pass printing unavoidably result in variations in dot landing positions. In printing apparatus of recent years, a dot alignment processing for adjusting the dot landing positions has become a necessary technology. The dot alignment processing is a method of adjusting positions on a print medium where dots are formed.

The dot alignment processing is briefly explained here. When performing a bidirectional printing, for examples variations may occur in landing positions between a forward scan and a backward scan. To correct these variations, the printing apparatus adjusts the timings at which to eject ink droplets during the forward scan and during the backward scan. An amount of correction for the alignment varies according to the printing apparatus, a print head and an environment in which the printing apparatus is used. Hence, the printing apparatus generally has a dot position adjust value calculation mode to determine an appropriate amount of correction.

In the dot position adjust value calculation mode, a plurality of line patterns are printed in forward scans and in backward scans. At this time all the line patterns are printed at a predetermined timing during the forward scans whereas during the backward scans the individual line patterns are printed by shifting the print timing by a predetermined amount from the preceding pattern. In a conventional, commonly used dot position adjust value calculation mode, a user checks a plurality of printed line patterns and selects a line pattern that exhibits the best alignment in the dot landing positions between the forward scan and the backward scan, i.e., a line pattern with the best linearity. Then, the user enters a parameter corresponding to the selected pattern directly into the printing apparatus through key manipulations. Alternatively, the user sets the dot position adjust value in the printing apparatus through an application by operating a host computer.

In more recent years, printing apparatus have been proposed which have a dot position adjust value calculation mode that permits an automatic setting of correction values without bothering the user at all. For example, Japanese Patent Application Laid-open Nos. 11-291470 (1999) and 11-291553 (1999) disclose a technology which detects printed test patterns by an optical sensor and automatically sets an adjust value obtained.

As described above, in the dot position adjust value calculation mode, a plurality of test patterns are printed on a print medium in a predetermined layout. Thus, the print medium is required to secure an area in which to print all test patterns. As to how a plurality of test patterns is detected, when an optical sensor is used for detecting the patterns in particular, it is not desired that the patterns are printed to the ends of the print medium. That is, it is desired that all the patterns be printed with some margins left at the ends.

However, ordinary printing apparatus are designed to accept various sizes of print mediums. In executing the dot position adjust value calculation mode, a print medium of a smaller size than that required by the test patterns may happen to be put on a paper feed tray. In that case, proceeding the dot position adjust value calculation mode as is may result in not all of the required patterns being printed on the print medium or a part of the individual patterns failing to be printed. In this situation the pattern detection cannot be performed normally. Further, the print medium used here is wasted. There is another problem. Since, when a print medium is fed, ink is ejected onto an area of platen that is not covered with the print medium, the platen will be contaminated with ink. If the next printing operation is executed with the platen left contaminated, another sheet newly supplied will be smeared by the platen.

SUMMARY OF THE INVENTION

The present invention has been accomplished to overcome the above drawbacks. It is therefore an object of this invention to provide a printing apparatus and a dot position adjusting method, which can execute a dot position adjust value calculation mode normally and smoothly without requiring a user to make a decision or adjustment or without wasting a print medium or contaminating an interior of the printing apparatus.

In a first aspect of the present invention, there is provided a printing apparatus that forms an image on a print medium by printing a colorant on it according to a dot matrix printing method using printing means having a plurality of print elements, the printing apparatus comprising: means for printing a first test pattern; first detection means for detecting the first test pattern; decision means for making a decision on an execution or non-execution of a printing of a second test pattern according to a size of the print medium, based on information obtained by the detection of the first test pattern by the first detection means; means for, when the decision means decides that the second test pattern should be printed, printing the second test pattern on the same print medium that the first test pattern is printed on; second detection means for detecting the second test pattern.

In a second aspect of the present invention, there is provided a printing method forming an image on a print medium using printing means having a plurality of print elements, the printing method comprising: a step of printing a first test pattern on the print medium; a first detection step of detecting the first pattern printed on the print medium by a first detecting means; a decision step of deciding an execution or non-execution of a printing of a second test pattern according to a size of the print medium, based on information obtained by the first detection step; a step of printing the second test pattern on the same print medium when it is determined that the second test pattern should be printed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of this invention will be described in detail by referring to the accompanying drawings.

In this specification, a word "print" means not only forming significant information such as characters and figures but also generally forming images, patterns or the like on a variety of print mediums, whether the information is significant or non-significant or whether visible or latent, and also processing the mediums.

A word "print medium" signifies not only paper commonly used in printing apparatus but also any kind of materials that can receive ink, such as cloth, plastic films, metal sheets, glass, ceramics, wood and leather.

(1) Basic Construction

First, a basic construction of a printing apparatus used in this embodiment will be described. Here, a printing apparatus of an ink jet-system (ink jet printer) is taken as an example.

(1-1) Printing Apparatus Body

Figure 1:
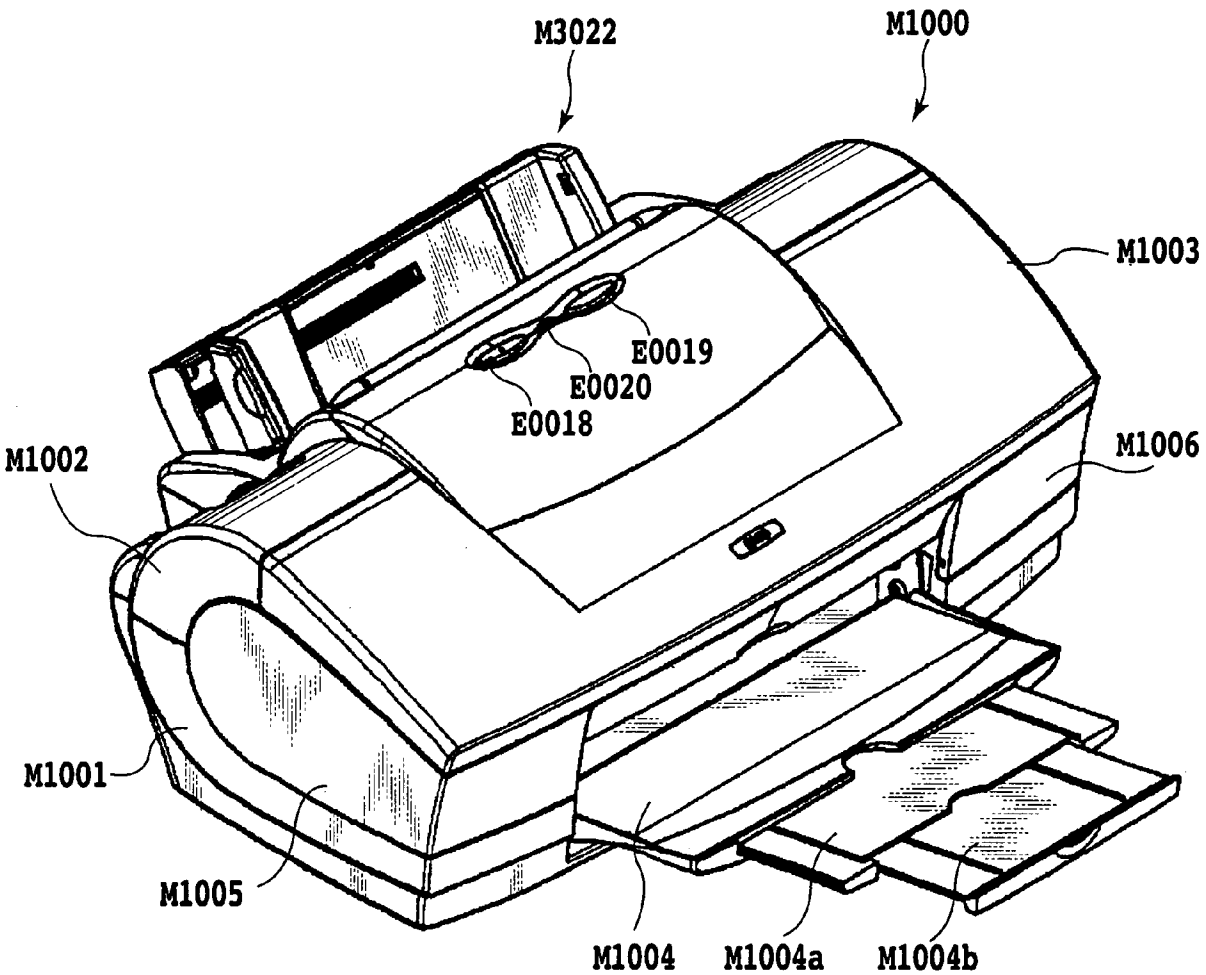
FIG. 1 is an external view of a printing apparatus as one embodiment of this invention.
Figure 2:
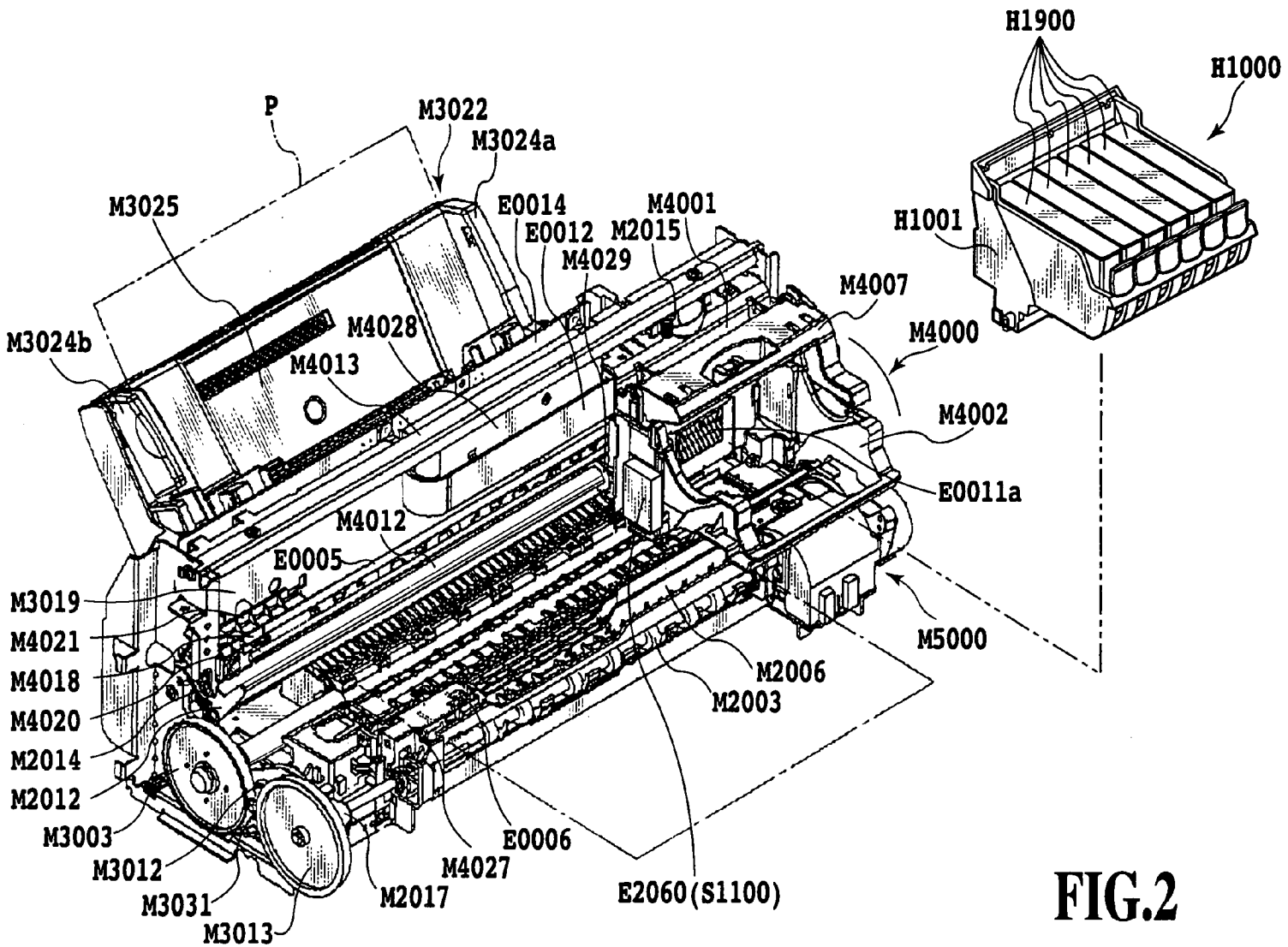
FIG. 2 is a perspective view showing an inner construction of the printing apparatus of the embodiment.

FIG. 1 is an external view of an ink jet printing apparatus of this embodiment FIG. 2 is a perspective view of the printing apparatus of FIG. 1 with an enclosure removed.

Referring to FIG. 1 and FIG. 2, a printing apparatus body M1000 forming an outer shell of the printing apparatus comprises an enclosure made up of a lower case M1001, an upper case M1002, an access cover M1003, a discharge tray M1004, a front cover (L) M1005 and a front cover (R) M1006, and a chassis M3019 accommodated in the enclosure.

The chassis M3019 is made of a plurality of platelike metal members with a predetermined stiffness and forms a skeleton of the printing apparatus to hold various portions of a printing mechanism described later. The lower case M1001 forms roughly a lower half of the printing apparatus body M1000 and the upper case M1002 forms roughly an upper half of the printing apparatus body M1000. These two cases combine to form a hollow structure having an accommodation space therein to accommodate a variety of mechanisms described later. Further, the upper surface and front surface of the printing apparatus body M1000 are each formed with an opening. The front cover (L) M1005 and the front cover (R) M1006 cover an adjoining portion of the lower case M1001 and the upper case M1002 to mainly improve an appearance.

The discharge tray M1004 is pivotally supported at one end thereof on the lower case M1001. The opening formed in the front surface of the lower case M1001 is opened and closed by the pivotal movement of this discharge tray M1004. In executing a printing operation, the discharge tray M1004 is pivoted forward to allow sheets of a print medium to be discharged from the opening and stacked successively on the discharge tray M1004. The discharge tray M1004 accommodates two auxiliary trays M1004*a* and M1004*b*, which can be pulled forward as required to expand a support area for the discharged print medium P in three steps.

The access cover M1003 is pivotally supported at one end thereof on the upper case M1002. The opening formed in the upper surface is opened and closed by the pivotal movement of the access cover M1003. With the access cover M1003 open, a head cartridge H1000 and ink tanks H1900 installed in the apparatus body can be replaced. As the access cover M1003 is opened or closed, a projection provided at the back of the cover causes a cover opening lever to rotate. A rotary position of this lever is detected by a micro switch to determine the open-close state of the access cover.

On the upper surface of a rear part of the upper case M1002 are provided a power key E1008 and a resume key E0019, that are depressed for operation, and a light emitting diode E0020. With the power key E1008 pressed to make the printing apparatus reads for printing, the LED E0020 lights up, indicating to an operator that the apparatus is now ready to print. The way the LED E0020 is turned on and off or blinked and the color of the LED can be changed. Further, in combination with a buzzer, the LED can indicate a variety of information. Thus, the operator can know the condition of the apparatus, including whether or not the apparatus can print or what kind of trouble the apparatus is in. After a trouble is cleared, the resume key E0019 is pressed to resume the printing operation.

(1-2) Printing Mechanism

Figure 3:
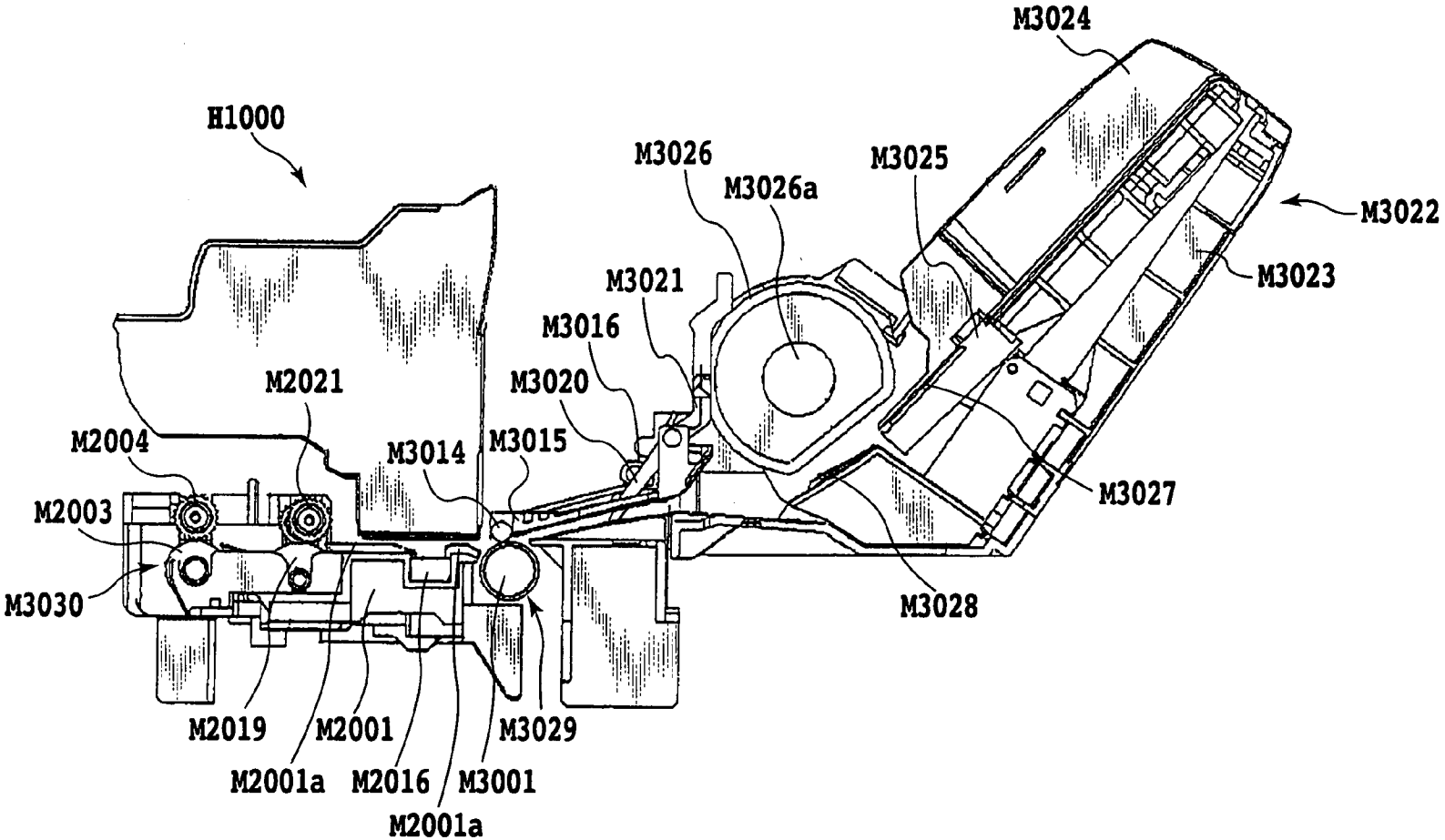
FIG. 3 is a schematic side view showing the inner construction of the printing apparatus of the embodiment.

Next, a printing mechanism accommodated in the printing apparatus body M1000 will be explained. FIG. 3 is a schematic side view showing an inner construction of the printing apparatus of FIG. 1. The following description is made by referring to FIG. 2 and FIG. 3.

This printing mechanism comprises an automatic feeding unit M3022, a transport unit M3029, a printing unit M4000, and a recovery unit M5000. The a feeding unit M3022 automatically feeds a print medium P into the printing apparatus body M1000. The transport unit M3029 introduces the print medium P fed one sheet at a time from the automatic feeding unit M3022 to a desired print position and from there to a discharge unit M3030. The printing unit M4000 has a print head H1001 and performs a desired printing operation on the print medium P that was carried there by the transport unit M3029. The recovery unit M5000 performs an ink ejection performance recovery operation on the print head H1001.

Each of these units will be described in more detail in the following.

(1-2a) Automatic Feeding Unit

The automatic feeding unit M3022 picks up the print medium P stacked at an angle of about 30–60° to a horizontal plane and feeds one sheet at a time in a horizontal state. Further, it sends the print medium P in almost the horizontal state into the printing apparatus body from a feed port not shown. The automatic feeding unit M3022, as shown in FIG. 2 and FIG. 3, includes a feed roller M3026, a movable side guide M3024, a pressure plate 3025, an ASF base M3023, a separation seat M3027, and a separation pad M3028.

The ASF base M3023 constitutes roughly an outer shell of the automatic feeding unit M3022 and is provided on the back of the apparatus body. On the front side of the ASP base M3023 the pressure plate 3025 that supports the print medium is mounted at an angle of 30–60° to a horizontal plane. A pair of movable side guides M3024*a* and M3024*b* that guide side edges of the print medium P are protruding from the ASF base M3023. One of the movable side guides, M3024*b*, is horizontally movable to match the horizontal width of the print medium P.

Pivotally supported on the left and right side surfaces of the ASF base M3023 is a drive shaft M3026*a* driven by an ASF motor through a transmission gear train (not shown). The drive shaft M3026*a* has secured thereto a plurality of feed rollers M3026 with differing circumferential surface contours.

As the feed rollers M3026 rotate, driven by the ASF motor, the separation seat M3027 and the separation pad M3028 perform a sheet separation action That is, of the stacked sheets of print medium P on the pressure plate 3025, only the uppermost sheet is separated and fed to the transport unit M3029.

A lower end of the pressure plate 3025 is elastically supported by a leaf spring (not shown) interposed between the pressure plate M3025 and the ASF base M3023. Thus, a contact force between the feed roller M3026 and the print medium P can be kept almost constant regardless of the number of sheets stacked.

In the transport path of the print medium P from the automatic feeding unit M3022 to the transport unit M3029, a PE lever M3020 is pivotally mounted on a pinch roller holder M3015 supported by the chassis M3019. Further, the PE lever M3020 is biased in a predetermined direction (counterclockwise in FIG. 3) by a PE lever spring M3021. In this construction, when a front end of the print medium P, that was picked up and transported from the automatic feeding unit M3022 through the transport path, pushes one end of the PE lever M3020 to rotate it, a PE sensor not shown detects the rotation of the PE lever M3020. That is, it is detected that the print medium P has entered into the transport path. After this detection, the print medium P is moved a predetermined distance downstream by the feed roller M3026. This transport action is stopped at a timing when the front end of the print medium P comes into contact with a nip portion between the LF roller M3001 and the pinch roller M3014, both at rest in the transport unit M3029, and the print medium deflects by a predetermined amount. The amount of deflection (size of a loop) at this time is about 3 mm.

(1-2b) Transport Unit

The transport unit M3029, as shown in FIG. 2 and FIG. 3, includes an LF roller M3001, a pinch roller M3014, a platen M2001 and a platen absorbent M2016. The LF roller M3001 is rotatably supported on the chassis M3019 through bearings (not shown).

An LF gear M3003 is secured to one end of the LF roller M3001 and meshes with an LF motor gear M3031 secured to an output shaft of the LF motor through an LF intermediate gear M3012. Therefore, the LF roller M3001 is rotated by the LF motor through a meshing gear train.

The pinch roller M3014 is rotatably mounted on a front end of the pinch roller holder M3015 that is pivotally supported on the chassis M3019. Further, the pinch roller holder M3015 is biased by a coiled pinch roller spring M3016. The pinch roller M3014 therefore is pressed against the LF roller M3001. As the LF roller M3001 rotates, the pinch roller M3014 follows the rotation of the LF roller M3001. The print medium P resting in the loop state is gripped between the LF roller M3001 and the pinch roller M3014 and transported downstream.

A rotating center of the pinch roller M3014 is offset about 2 mm downstream of a rotating center of the LF roller M3001 in the transport direction. With this arrangement, the print medium P transported by the LF roller M3001 and the pinch roller M3014 is forwarded toward left downwardly in FIG. 3. As a result, the print medium P is carried along a print medium support surface M2001*a* of the platen M2001.

In the transport unit constructed as described above, when a predetermined time after the transport operation by the feed roller M3026 in the automatic feeding unit M3022 has stopped has been lapsed, the LF motor is started. The driving force of the LF motor is transmitted through the LF intermediate gear M3012 and the LF gear M3003 to the LF roller M3001. As a result, the print medium P with its front end in contact with the nip portion between the LF roller M3001 and the pinch roller M3014 is transported by the rotation of the LF roller M3001 to a print start position on the platen M2001.

During the above transport operation, the feed roller M3026 starts to be rotated again simultaneously with the LF roller M3001. The print medium P therefore is carried downstream for a predetermined time by the cooperation of the feed roller M3026 and the LF roller M3001. The carriage M4001 is reciprocated in a direction (main scan direction) crossing (perpendicularly for example) the direction of transport of the print medium P along a carriage shaft M4012 whose ends are securely supported on the chassis M3019. The head cartridge H1000 mounted on the carriage M4001 ejects ink onto the print medium P held at the print start position moving together with the carriage M4001. As a result, an image is printed according to predetermined information.

After the printing is done in the main scan direction, the LF roller M3001 is rotated to feed the print medium a predetermined distance. The print medium may be fed one line width, for example 5.42 mm, at a time. After the transport operation is finished, the carriage M4001 and the head cartridge H1000 move along the carriage shaft M4012 for printing on the next line. The above sequence of operation is executed repetitively to form an image on the print medium P on the platen M2001.

The carriage shaft M4012 is mounted at one end on a paper gap adjust plate (R) not shown and at the other end on a paper gap adjust plate (L) M2012 and biased by a carriage shaft spring M2014. These paper gap adjust plates are adjusted to set a distance between a nozzle face of the head cartridge H1000 and the print medium support surface M2001*a* of the platen M2001 to an appropriate value and are secured to the chassis M3019.

A paper gap adjust lever M2015 can choose one of two stop positions, a left position shown in FIG. 2 and a right position not shown. Moving the paper gap adjust lever M2015 to the right position causes the carriage M4001 to stand by about 0.6 mm from the platen M2001. When the print medium P is thick, such as an envelope, the paper gap adjust lever M2015 is shifted to the right position before starting the feeding operation by the automatic feeding unit M3022.

If the paper gap adjust lever M2015 is set to the right position, this state is detected by a gap sensor. Therefore, when the print medium P begins to be fed by the automatic feeding unit M3022, it is possible to check if the position setting of the paper gap adjust lever M2015 is appropriate or not based on an output of the gap sensor. If the positional relationship is decided to be not appropriate, the printing apparatus issues a warning by displaying a message or activating a buzzer. This prevents the printing operation from being executed in an inappropriate state.

(1-2c) Discharge Unit

Figure 4:
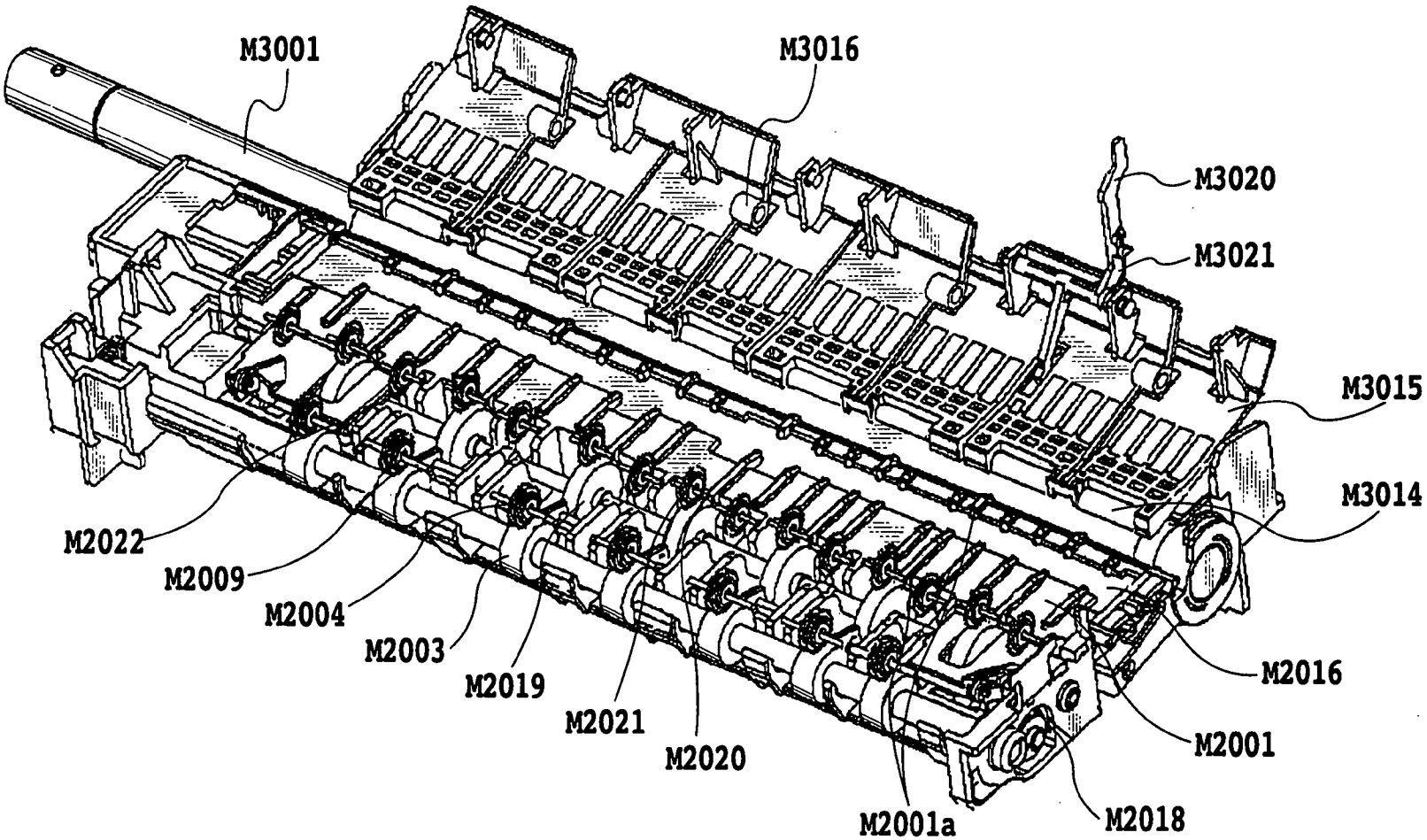
FIG. 4 is a perspective view showing the inner construction of the printing apparatus of the embodiment with some components removed.

FIG. 4 is a perspective view showing a part of the inner construction of the printing apparatus of FIG. 2 with the head cartridge H1000 removed.

The discharge unit M3030 comprises first discharge rollers M2003, a discharge gear M3013, a discharge transmission gear mounted on one end of a shaft of the first discharge rollers M2003, a discharge transmission intermediate gear M2018 in mesh with the discharge transmission gear, second discharge rollers M2019 having a discharge transmission gear formed integral therewith which is in mesh with the discharge transmission intermediate gear M2018, a spur base M2006 on which to mount spurs described later, first spurs M2004, second spurs M2021, and a discharge tray M1004 to receive discharged sheets of print medium P.

The first discharge rollers M2003 are arranged downstream of the print medium P in the transport direction and each has one end rotatable supported on the platen M2001 and the other end rotatable supported on the chassis M3019 through a first discharge roller bearing M2017. The discharge gear M3013 is mounted on one end of the shaft of the first discharge rollers M2003 to transmit a drive force of the LF motor to the first discharge rollers M2003 through the LF intermediate gear M3012. The first spurs M2004 are pressed against the first discharge rollers M2003 by a spur spring shaft M2009 attached to the spur base M2006 and thus follow the rotation of the first discharge rollers M2003 to transport the print medium P by holding It between the first discharge rollers M2003 and the first spurs. The second spurs M2021 are pressed against the second discharge rollers M2019 by a spur spring shaft M2020 attached to the spur base M2006 and thus follow the rotation of the second discharge rollers M2019 to transport the print medium P by holding it between the second discharge rollers M2019 and the second spurs.

The print medium P transported to the discharge unit M3030 receives a moving force from the first discharge rollers M2003 and the first spurs M2004 and a moving force from the second discharge rollers M2019 and the second spurs M2021. The rotating center of the second spurs M2021 is offset about 2 mm upstream of the rotating center of the second discharge rollers M2019 in the transport direction. Thus, the print medium P transported by the second discharge rollers M2019 and the second spurs M2021 lightly contacts the print medium support surface M2001*a* of the platen M2001 without forming a gap between the print medium and the support surface, ensuring an appropriate and smooth transport of the print medium.

A first transport speed based on the first discharge rollers M2003 and first spurs M2004 and the second discharge rollers M2019 and second spurs M2021 is set almost equal toga second transport speed based on the LF roller M3001 and the pinch rollers M3014. To prevent the print medium P from becoming slack, the second transport speed may be set slightly faster.

The spur base M2006 is provided with third spurs at positions between the second spurs M2021 and slightly downstream of the second spurs M2021 and upstream of the first spurs M2004 but which do not oppose the second discharge rollers M2019. This arrangement causes the print medium P to be undulated lightly. The print medium P, after being printed, produces a slight elongation. This elongation is absorbed by the undulations, thus keeping the print medium P from contacting the print head H1000.

After the print medium P has been formed with an image and its rear end has come out between the LF roller M3001 and the pinch rollers M3014, the print medium P is transported only by the first discharge rollers M2003 and first spurs M2004 and the second discharge rollers M2019 and second spurs M2021 for discharging.

(1-2d) Printing Unit

Referring again to FIG. 2, the printing unit M4000 comprises a carriage M4001 movably supported on the carriage shaft M4021 and a head cartridge H1000 removably mounted on the carriage M4001.

The head cartridge H1000, as shown in FIG. 2, has ink tanks H1900 containing inks and a print head H1001 to eject inks supplied from the ink tanks H1900 from its nozzles according to print information. The print head H1001 is removably mounted on the carriage M4001, a structure of a so-called cartridge type.

The head cartridge H1000 of FIG. 2 can produce a high quality photographic color print. The ink tanks H1900 are independent color ink tanks, such as black, light cyan, light magenta, cyan, magenta and yellow tanks, all individually removable from the print head H1001.

The carriage M4001 has a carriage cover M4002 and a head set lever M4007. The carriage cover M4002 engages the carriage M4001 to guide the print head H1001 to its mounting position in the carriage M4001 The head set lever M4007 engages an upper part of the print head H1001 and pushes it down to a predetermined mounting position. A paper width sensor E2060, one of the features of this invention, is provided on the side of the carriage M4001 and moves with the carriage M4001 for scan.

The head set lever M4007 is pivotally mounted on a top of the carriage M4001. At an engaged portion between the head set lever M4007 and the print head H1001, a head set plate not shown is installed through a spring. The force of this spring presses down the print head H1001 for mounting on the carriage M4001.

At another engagement portion between the carriage M4001 and the print head H1001 there is provided a contact flexible print cable (contact FPC). A contact portion E0011*a* on the contact FPC and a contact portion not shown (external signal input terminal) on the print head H1001 are electrically connected together for transfer of a variety of print information and for supply of power to the print head H1001.

Between the contact portion E0011*a* of the contact FPC and the carriage M4001 is installed an elastic member not shown, such as rubber An elastic force of the elastic member and the pressing force of the head set lever spring combine to make the contact between the contact portion E0011*a* and the print head H1001 on the carriage M4001 reliable. The contact FPC is drawn out to the side surfaces of the carriage M4001, to which the contact FPC's end portions are secured by a pair of FPC retainers (not shown). Further, the contact FPC is connected to a carriage printed circuit board mounted on the back of the carriage M4001. The carriage printed circuit board (CRPCB) E0013 is connected to a main printed circuit board E0014 through a carriage flexible flat cable (carriage FFC) E0012.

A farther end of the carriage FFC E0012 is secured to the chassis M3019 by a FFC retainer M4028. It is drawn out to the back side of the chassis M3019 through a hole, not shown, in the chassis M3019 and then connected to the main printed circuit board.

The carriage printed circuit board is provided with an encoder sensor. The encoder sensor detects a position and a scan speed of the carriage M4001 by reading information on an encoder scale E0005 extending parallel to the carriage shaft M4012 between side surfaces of the chassis M3019. In this embodiment, the encoder sensor is an optical transmission type sensor. The encoder scale E0005 is a film of resin, such as polyester, printed with alternating light shielding and light transmitting portions arranged at a predetermined pitch by using a photographic printing method and the like, The light shielding portion is a portion that interrupts a transmission of light from the encoder sensor and the light transmitting portion is a portion that allows light to pass through.

The position of the carriage M4001 moving along the carriage shaft M4012 can be detected by the encoder sensor counting the number of patterns formed on the encoder scale E0005. Prior to starting the detection, the carriage M4001 is held to one of the side plates of the chassis M3019 which constitute ends of the scan stroke of the carriage M4001. This position is taken as a reference for detection.

The carriage M4001 is guided along the carriage shaft M4012 and carriage rail M4013 both extending between the side surfaces of the chassis M3019 to perform scanning The carriage shaft M4012 has a pair of carriage bearings M4029 formed integral therewith at its bearing portions through an insert molding or the like, the carriage bearings M4029 being sintered metals impregnated with a lubricating oil.

The carriage M4001 is secured to a carriage belt M4018 which is stretched almost parallel to the carriage shaft between an idler pulley M4020 and a carriage motor pulley (not shown). As the carriage motor pulley is driven by a carriage motor, the carriage belt M4018 is moved in a forward or backward direction, carrying with it the carriage M4001 along the carriage shaft M4012 for scan.

The carriage motor pulley is held at a predetermined position on the chassis M3019. The idler pulley M4020 is held movable together with a pulley holder M4021 relative to the chassis M3019 and is biased by a spring away from the carriage motor pulley. Therefore, the carriage belt M4018 stretched between the two pulleys is given an appropriate tension at all times and kept in good condition without a slack. Between the carriage belt M4018 and the carriage M4001 there is provided a carriage belt retainer (not shown) which reliably holds the carriage M4001.

On a scan path of the carriage M4001 on the spur base M2006, an ink end sensor E0006 is provided at a position facing the ink tanks H1900. This arrangement makes it possible to detect remaining amounts of ink in the ink tanks H1900 of the head cartridge H1000 mounted on the carriage M4001. The ink end sensor E0006 is accommodated in an ink end sensor cover M4027 having a metal plate. This cover shields the ink end sensor E0006 from external noise, preventing undesired operations of the sensor.

(1-2e) Recovery Unit

A recovery unit M5000 performs an ink ejection performance recovery operation on the head cartridge H1000 and comprises a recovery system unit removably mounted on the printing apparatus body M1000. The recovery system unit includes a cleaning means for removing foreign matters from a print element substrate of the print head H1001 and a recovery means for putting an ink path from the ink tanks H1900 to tie print element substrate of the print head H1001 in good condition.

(1-3) Electric Circuit

Figure 5:
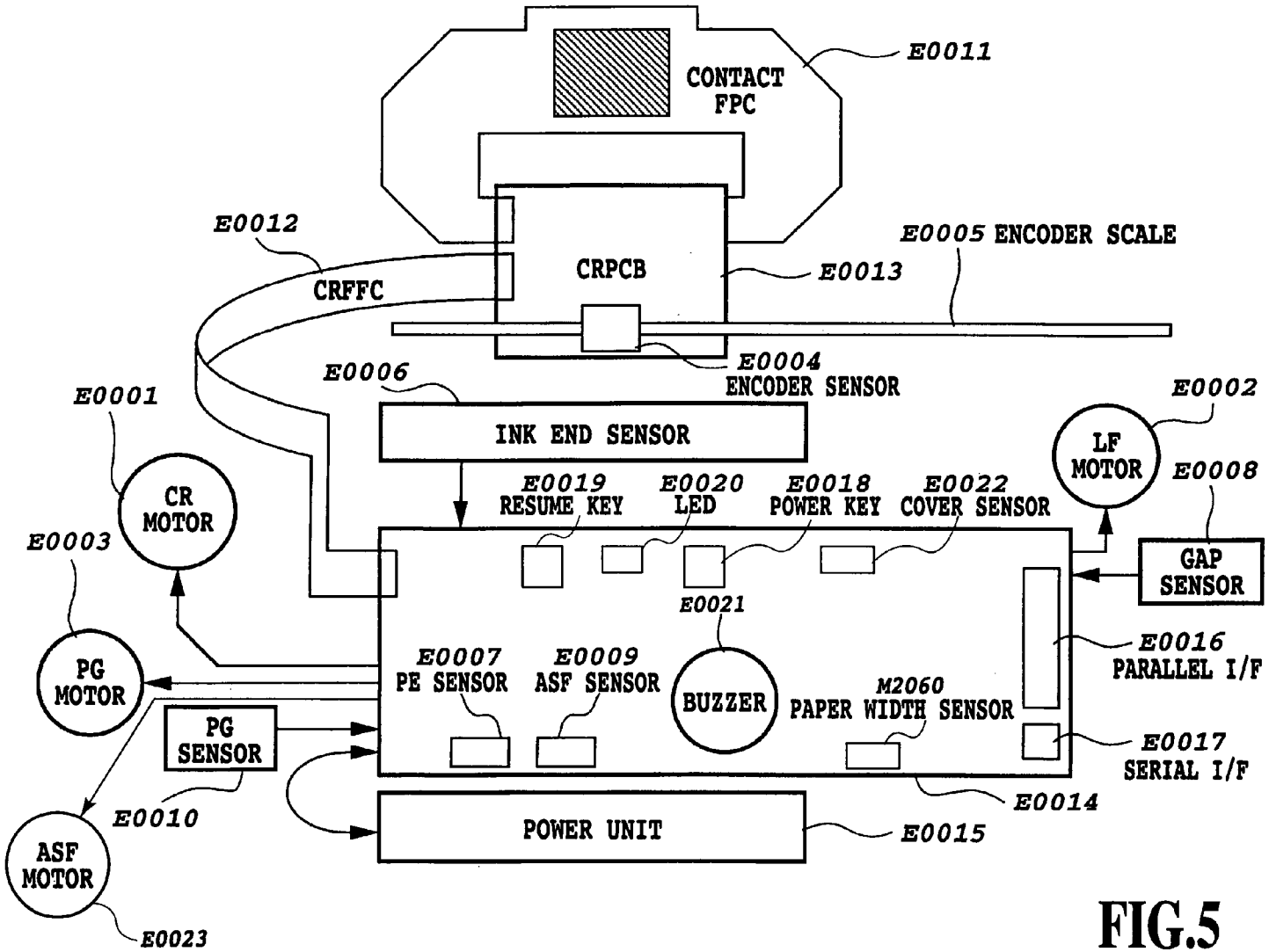
FIG. 5 is a block diagram schematically showing an overall configuration of an electric circuit of the printing apparatus of the embodiment.

Next, an electric circuit configuration of the printing apparatus will be explained. FIG. 5 is a block diagram schematically showing an overall configuration of the electric circuit of the printing apparatus described above.

Referring to FIG. 5, this electric circuit comprises mainly a carriage printed circuit board (CRPCB) E0013, a main printed circuit board E0014, and a power supply unit E0015.

The power supply unit E0015 is connected to the main PCB E0014 to supply electricity to various parts. The carriage PCB E0013 is a printed circuit board unit mounted on the carriage M4001 which functions as an interface to transfer signals to and from the print head H1001 through the contact flexible print cable (FPC) E0011. Further, based on pulse signals that are output from the encoder sensor E0004 as the carriage M4001 moves, the carriage PCB E0013 detects a change in positional relation between the encoder scale E0005 and the encoder sensor E0004 and outputs a signal representing the positional relation change through the flexible flat cable (CRFFC) E0012 to the main PCB E0014.

The main PCB E0014 is a printed circuit board unit that controls various parts in the printing apparatus described above and has on its board I/O ports for a paper end sensor (PE sensor) E0007, ASF sensor E0009, cover sensor E0022, parallel interface (parallel I/F) E0016, serial interface (serial I/F) E0017, resume key E0019, LED E0020, power key E1008, and buzzer E0021, and paper width sensor E2060 characteristic of this invention. The main PCB E0014 also is connected to a CR motor E0001, LF motor E0002, PG motor E0003 and ASF motor E0023 to control their operations. Further, the main PCB E0014 has connection interfaces with an ink end sensor E0006, gap sensor E0008, PG sensor E0010, CRFFC E0012, and power supply unit E0015.

Figures 6, 6A:
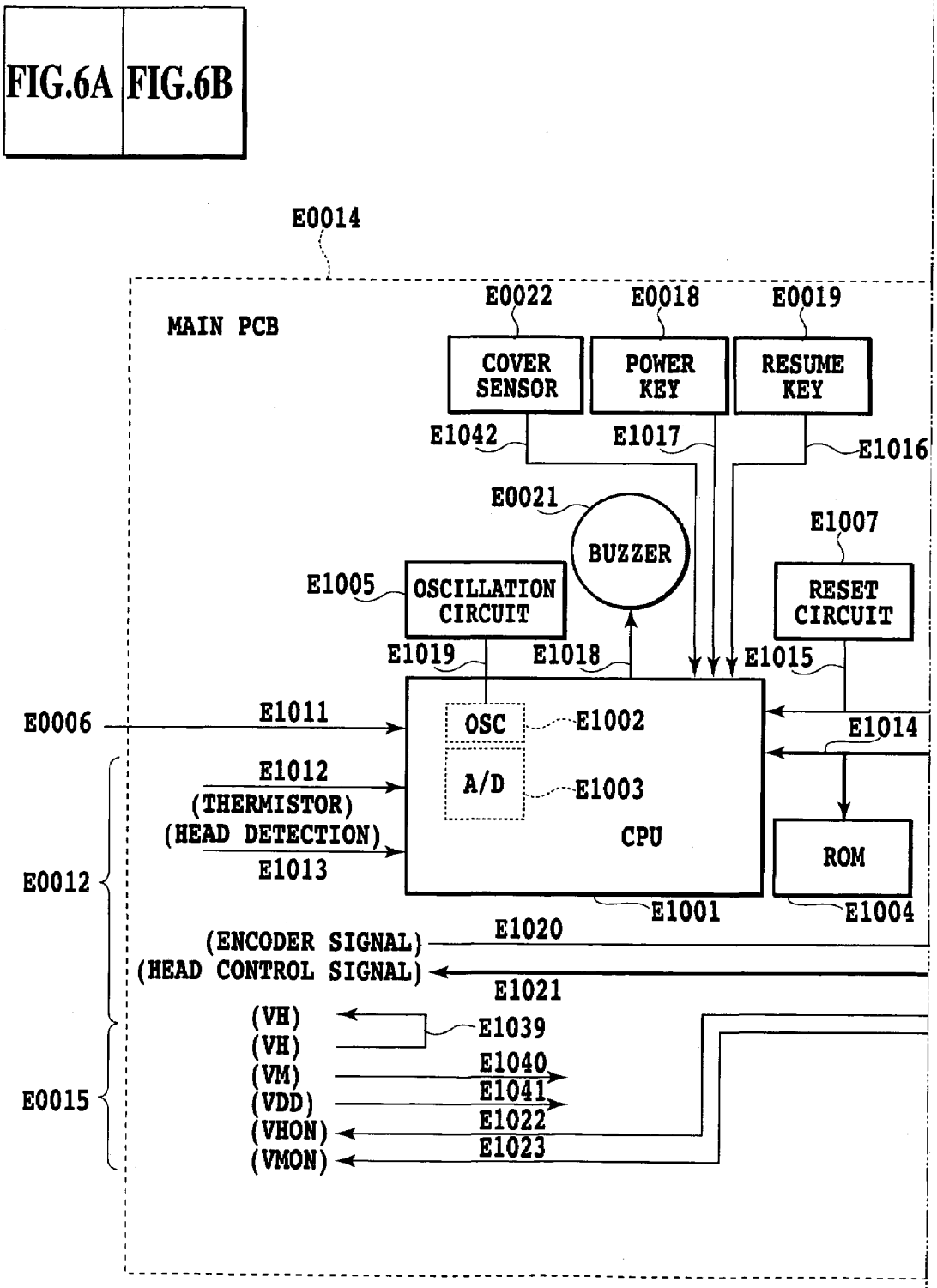
FIG. 6 is a diagram showing the relationship of FIGS. 6A and 6B.
FIG. 6A is a block diagram showing an inner configuration of a main PCB of FIG. 5.
Figure 6B:
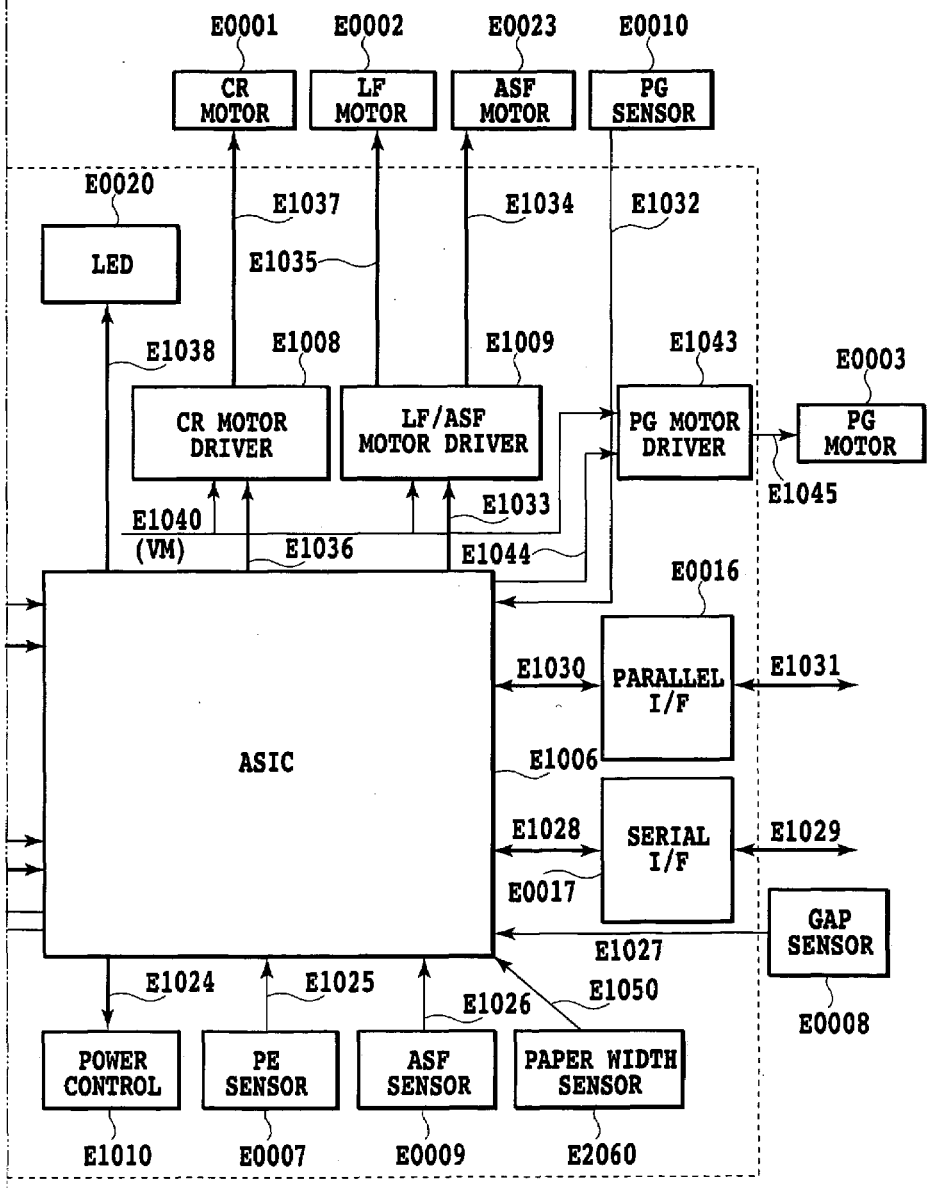
FIG. 6B is a block diagram showing an inner configuration of a main PCB of FIG. 5.

FIGS. 6A and 6B are a block diagram showing an inner configuration of the main PCB E0014. Referring to FIGS.

6A and 6B, denoted E1001 is a CPU. The CPU E1001 has on oscillator (OSC) E1002 therein which is connected to an oscillation circuit E1005 and produces a system clock according to an output signal E1019 of the oscillation circuit E1005. The CPU E1001 is also connected through a control bus E1014 to a ROM E1004 and an ASIC (Application Specific Integrated Circuit) E1006. Thus, the CPU E1001, according to a program installed in the ROM E1004, performs control on the ASIC E1006 and makes a status check with an input signal E1017 from the power key E1008, an input signal E1016 from the resume key E0019, a cover detection signal E1042, and a head detection signal (HS-ENS) E1013. The CPU also sounds a buzzer E0021 through a buzzer signal (BUZ) E1018 and performs a status check with the ink end detection signal (INKS) E1011 and the thermistor temperature detection signal (TH) E1012, both connected to an A/D converter E1003 built into it. In addition, the CPU performs various other logic operations, makes conditional decisions and controls the operation of the ink jet printer.

The head detection signal E1013 is a head mounting state signal which is supplied from the head cartridge H1000 to the CPU via the CRFFC E0012, carriage PCB E0013 and contact FPC E0011 The ink end detection signal E1011 is an analog signal output from the ink end sensor E0006. The thermistor temperature detection signal E1012 is an analog signal from a thermistor (not shown) provided on the carriage PCB E0013.

Denoted E1008 is a CR motor driver E1008 which uses a motor voltage (VM) E1040 to generate a CR motor drive signal E1037 according to a CR motor control signal E1036 from the ASIC E1006 to drive the CR motor E0001.

Designated E1009 is a LF/ASF motor driver, which uses the motor voltage E1040 to generate a LF motor drive signal E1035 according to a pulse motor control signal (PM control signal) E1033 from the ASIC E1006 to drive the LF motor E0002. At the same time, the LF/ASF motor driver E1009 generates an ASF motor drive signal E1034 to drive the ASF motor E0023.

Denoted E1043 is a PG motor driver, which uses the motor voltage E1040 to generate a PG motor drive signal E1045 according to a pulse motor control signal (PM control signal) E1044 from the ASIC E1006 to drive the PG motor E0003.

Denoted E1010 is a power control circuit, which, according to a power control signal E1024 from the ASIC E1006, controls a power supply to each sensor having a light emitting element. The parallel interface E0016 transfers a parallel I/F signal E1030 from the ASIC E1006 to an externally connected parallel I/F cable B1031 and also a signal from the parallel I/P cable E1031 to the ASIC E1006. The serial interface E0017 transfers a serial I/F signal E1028 from the ASIC E1006 to an externally connected serial I/F cable E1029 and also a signal from the serial I/F cable E1029 to the ASIC E1006.

The power supply unit E0015 provides a head voltage (VH) E1039, a motor voltage (VM) E1040 and a logic voltage (VDD) E1041. The ASIC E1006 supplies a head voltage ON signal (VHON) E1022 and a motor voltage ON signal (VMOM) E1023 to the power supply unit E0015 to control the ON/OFF switching of the head voltage E1039 and the motor voltage E1040. The logic voltage (VDD) E1041 supplied from the power supply unit E0015 is voltage-transformed as required before being supplied to various parts inside or outside the main PCB E0014. The head voltage E1039 is smoothed by the main PCB E0014 and then sent to the carriage FFC E0012 to drive the head cartridge H1000.

Denoted E1007 is a reset circuit. The reset circuit E1007, when it detects a drop in the logic voltage E1041, sends a reset signal E1015 to the CPU E1001 and the ASIC E1006 for initialization.

The ASIC E1006 is a one-chip semiconductor integrated circuit. The ASIC E1006 is controlled by the CPU E1001 through the control bus E1014 to output the CR motor control signal E1036, pulse motor control signal E1033, power control signal E1024, head voltage ON signal E1022 and motor voltage ON signal E1023, and to transfer signals to and from the parallel interface E0016 and the serial interface E0017. The ASIC E1006 also makes a status check with a PE detection signal (PES) E1025 from the paper end sensor E0007, a ASF detection signal (ASFS) E1026 from the ASF sensor E0009, a gap detection signal (GAPS) E1027 from the GAP sensor E0008, a PG detection signal (PGS) E1032 from the PG sensor E0010 and a paper width detection signal E1050 from the paper width sensor E2060 characteristic of this invention and transfers data representing their statuses to the CPU E100 through the control bus E1014. Further, based on data entered, the ASIC E1006 generates a LED drive signal E1038 to control the ON/OFF switching of the LED E0020.

The ASIC E1006 also detects a status of an encoder signal (ENC) E1020 to generate a timing signal and interfaces with the head cartridge H1000 through a head control signal E1021 to control the printing operation. The encoder signal (ENC) E1020 is an output signal of the encoder sensor E0004 supplied through the carriage FFC E0012. The head control signal E1021 is supplied to the print head H1001 through the carriage FFC E0012, carriage PCB E0013 and contact FPC E0011.

Figures 7, 7A:
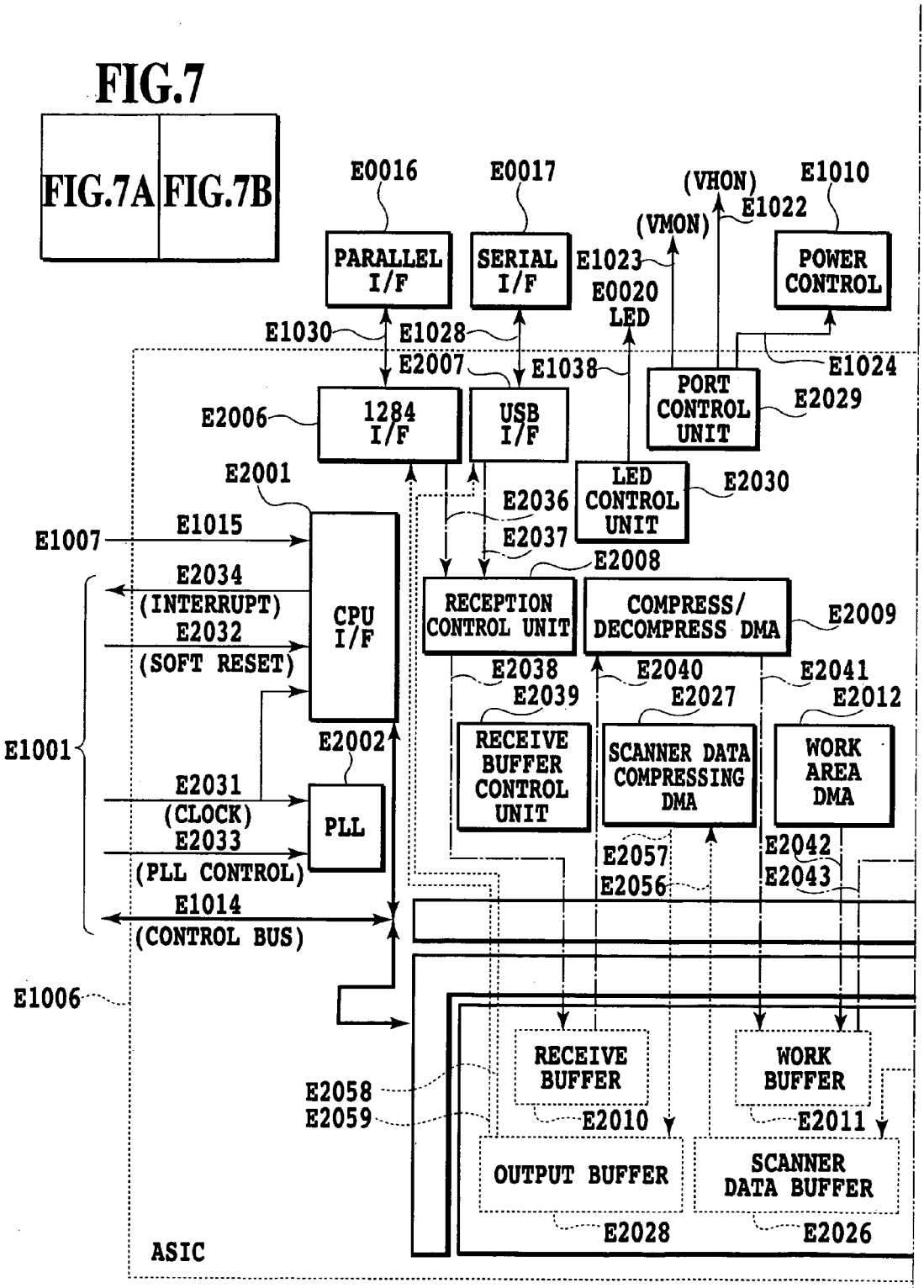
FIG. 7 is a diagram showing the relationship of FIGS. 7A and 7B.
FIG. 7A is a block diagram showing an inner configuration of an ASIC of FIGS. 6A and 6B.
Figure 7B:
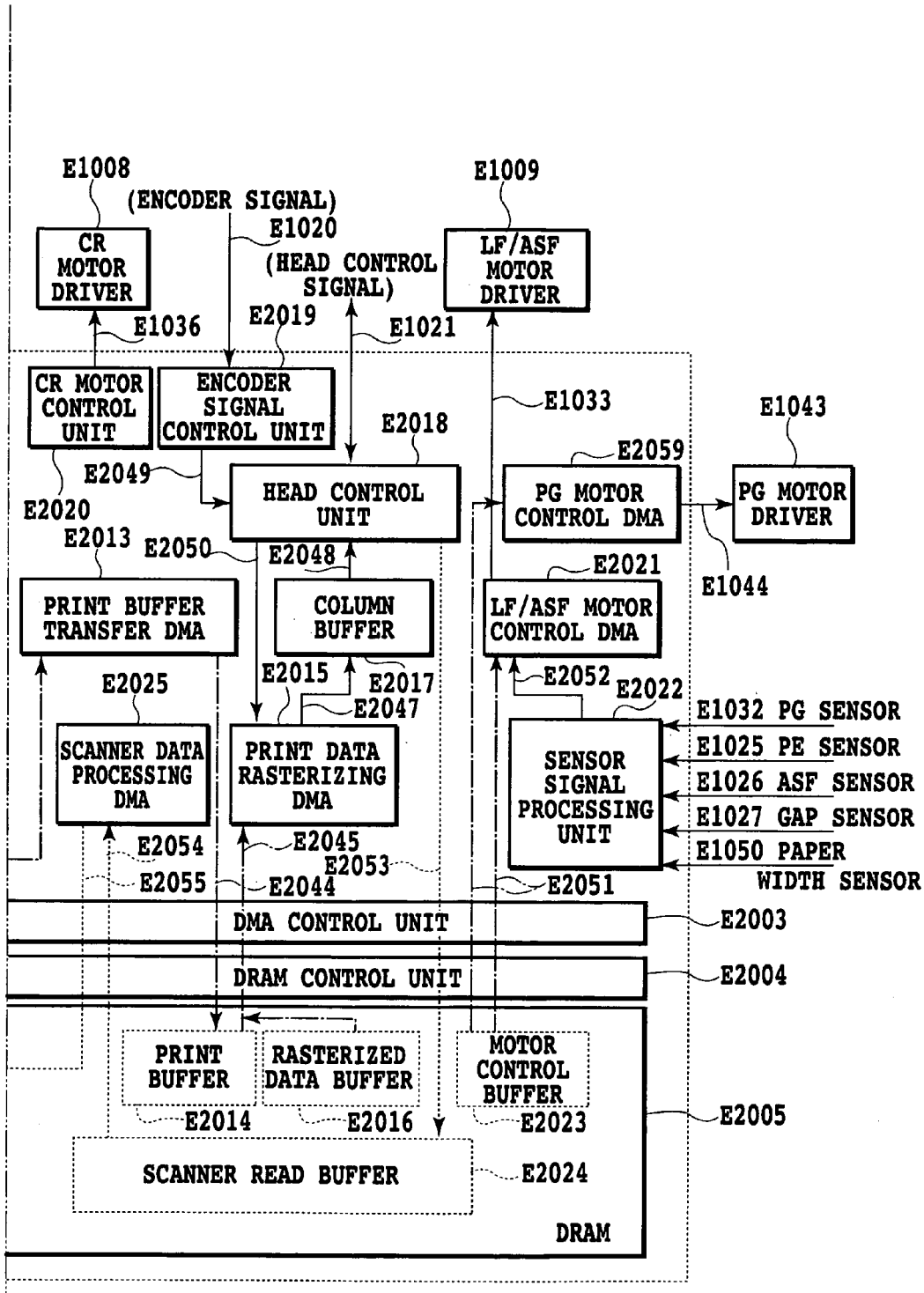
FIG. 7B is a block diagram showing an inner configuration of an ASIC of FIGS. 6A and 6B.

FIGS. 7A and 7B are a block diagram showing an inner configuration of the ASIC E1006. The diagram shows only the flow of data associated with the control of the print head and various mechanism components, such as print data and motor control data. So, control signals and clocks associated with the reading and writing of registers incorporated in individual blocks and a control signal for a DMA control are omitted here to avoid complexity of the drawing.

In FIGS. 7A and 7B, denoted E2002 is a PLL, which, based on a clock signal (CLK) E2031 and a PLL control signal (PLLON) E2033 both output from the CPU E1001 of FIGS. 6A and 6B, generates clocks to be supplied to most of the components in the ASIC E1006.

Denoted E2001 is a CPU interface (CPU I/F). The CPU I/F E2001 controls reads and writes of registers in various blocks as described below according to a reset signal E1015, a soft reset signal (PDWN) E2032 and a clock signal (CLK) E2031, both output from the CPU E1001, and control signals from the control bus E1014. The CPU I/F E2001 also supplies clocks to a part of the blocks and accepts Interrupt signals (neither is shown), and outputs an interrupt signal (INT) E2034 to the CPU E1001 to inform it of an occurrence of an interrupt in the ASIC E1006.

Designated 2005 is a DRAM. The DRAM E2005 has print data buffer areas, such as a receive buffer E2010, a work buffer E2011, a print buffer E2014 and a rasterized data buffer E2016. It also has a motor control buffer E2023 for motor control. Buffer areas, such as a scanner read buffer E2024, a scanner data buffer E2026 and an output buffer E20288, are also provided which are used during a scanner mode to replace the print data buffers.

The DRAM E2005 is also used as a work area for the operation of the CPU E1001. Denoted 92004 is a DRAM control unit. The DRAM control unit E2004 performs reads and writes on the DRAM E2005 by switching an access via the control bus E1014 between an access from the CPU E1001 to the DRAM E2005 and an access from a DMA control unit E2003 to the DRAM E2005.

The DMA control unit E2003 receives requests (not shown) from various blocks and outputs address signals, control signals (not shown) and write data (E2038, E2041, E2044, E2053, E2055, E2057) for the write operation to the DRAM control unit E2004 to access the DRAM. For the read operation, the DMA control unit E2003 transfers the read data from the DRAM control unit E2004 (E2040, E2043, E2045, E2051, E2054, E2056, E2058, E2059) to the requesting blocks.

Denoted E2006 is a 1284 I/F. The 1284 I/F E2006 is controlled by the CPU E1001 through the CPU I/F E2001 to provide a bidirectional communication interface with an external host device not shown via the parallel interface E0016. The 1284 I/F E2006, during the printing operation, transfers received data the parallel interface E0016 (PIP receive data E2036) to a reception control unit E2008 through DMA processing. Further, the 1284 I/F E2006, during the scanner reading operation, sends data stored in the output buffer E2028 in the DRAM E2005 (1284 transmit data (RDPIF) E2059) to the parallel interface E0016 through DMA processing.

Denoted E2007 is a USB I/F The USB I/F E2007 is controlled by the CPU E1001 through the CPU I/F E2001 to provide a bidirectional communication interface with an external host device not shown via the serial interface E0017. The USB I/F E2007, during the printing operation, transfers received data from the serial interface E0017 (USB receive data E2037) to the reception control unit E2008 through DMA processing. Further, the USB I/F E2007, during the scanner reading operation, sends data stored in the output buffer E2028 in the DRAM E2005 (USB transmit data (RDUSB) E2058) to the serial interface E0017 through DMA processing. The reception control unit E2008 writes receive data (WDIF) E2038 from the selected I/F, 1284 I/F B2006 or UTSB I/F E2007, into a receive buffer write address managed by a receive buffer control unit E2039.

Denoted E2009 is a compress/decompress DMA. The compress/decompress DMA E2009 is controlled by the CPU E1001 through the CPU I/F E2001 to read receive data (raster data) stored on the receive buffer E2010 from a receive buffer read address managed by the receive buffer control unit E2039. Further, it compresses or decompresses the read data (RDWK) E2040 according to a specified mode and writes it as a print code string (WDWK) B2041 in a work buffer area.

Denoted E2013 is a print buffer transfer DMA. The print buffer transfer DMA E2013 is controlled by the CPU E1001 through the CPU I/F E2001 to read a print code (RDWP) E2043 on the work buffer E2011. Further, it rearranges the order of print codes thus read out into addresses on the print buffer E2014 that match a data transfer order in which they are sent to the head cartridge H1000, and then transfers the re-ordered print codes (WDWP E2044).

Denoted E2012 is a work area DMA. The work area DMA E2012 is controlled by the CPU E1001 through the CPU I/F E2001 to repetitively write specified work fill data (WDWF) E2042 into an area on the work buffer E2011 from which the print codes have been transferred by the print buffer transfer DMA E2013.

Denoted E2015 is a print data rasterizing DMA. The print data rasterizing DMA E2015 is controlled by the CPU E1001 through the CPU I/F E2001 to read, triggered by a data rasterizing timing signal E2050 from a head control unit E2018, the print codes that were rearranged and written into the print buffer E2014 and rasterized data written into the rasterized data buffer E2016. Further, the print data rasterizing DMA E2015 generates rasterized print data (RDHDG) E2045 and writes it as column buffer write data (WDHDG) E2047 into a column buffer E2017.

The column buffer E2017 is an SRAM that temporarily stores data to be transferred to the head cartridge H1000 (rasterized print data). The column buffer E2017 is shared and managed by the print data rasterizing DMA E2015 and the head control unit E2018 through a handshake signal (not shown).

The head control unit E2018 is controlled by the CPU E1001 through the CPU I/F E2001 to interface with the head cartridge H1000 or scanner through the head control signal. The head control unit E2018 also outputs to the print data rasterizing DMA E2015 the data rasterizing timing signal E2050 based on a head drive timing signal E2049 from an encoder signal control unit E2019.

During the printing operation, the head control unit E2018 reads rasterized print data (RDHD) E2048 from the column buffer according to the head drive timing signal E2049 and outputs it as the head control signal E1021 to the head cartridge H1000.

During the scanner read mode, the head control unit E2018 DMA-transfers input data (WDHD) E2053 to the scanner read buffer E2024 on the DRAM E2005.

Denoted E2025 is a scanner data processing DMA. The scanner data processing DMA E2025 is controlled by the CPU E1001 through the CPU I/F E2001 to read out read buffer data (RDAV) E2054 stored in the scanner read buffer E2024 and write processed data (WDAV) E2055, that has undergone processing such as equalization, into the scanner data buffer E2026 on the DRAM E2005.

Denoted E2027 is a scanner data compressing DMA The scanner data compressing DMA E2027 is controlled by the CPU E1001 through the CPU I/F E2001 to read processed data (RDYC) E2056 from the scanner data buffer E2026, compress it and transfer compressed data (WDYC) E2057 to the output buffer E2028.

The encoder signal control unit E2019, upon receiving the encoder signal (ENC), outputs the head drive timing signal E2049 according to the mode determined by the CPU E1001. The encoder signal control unit E2019 stores information about the position and speed of the carriage M4001 obtained from the encoder signal E1020 in a register for use by the CPU E1001 Based on this information, the CPU E1001 determines a variety of parameters used in controlling the CR motor E0001.

Denoted E2020 is a CR motor control unit. The CR motor control unit E2020 is controlled by the CPU E1001 through the CPU I/F E2001 to output a CR motor control signal E1036 to the CR motor driver E1008.

Denoted E2022 is a sensor signal processing unit. The sensor signal processing unit E2022 receives a variety of detection signals from PG sensor E0010, paper end sensor E0007, ASF sensor E0009, gap sensor E0008 and paper width sensor E2060 (E1032, E1025, E1026, E1027, E1050) and, according to the mode determined by the CPU E1001, transfers these sensor information to the CPU E1001. The sensor signal processing unit E2022 outputs a sensor detection signal E2052 to a LF/ASP motor control DMA E2021.

The LF/ASF motor control DMA E2021 and the PG motor control DMA E2059 are controlled by the CPU E1001 through the CPU I/F E2001 to read a pulse motor drive table (RDPM) E2051 from the motor control buffer E2023 on the DRAM E2005 and output pulse motor control signals E1033, E1044. Depending on the operation mode, these DMA's uses a sensor detection signal as a control trigger to output the pulse motor control signals E1033, E1044.

Denoted E2030 is an LED control unit E2030. The LED control unit E2030 is controlled by the CPU E1001 through the CPU I/F E2001 to output an LED drive signal E1038. The port control unit E2029 is controlled by the CPU E1001 through the CPU I/F E2001 to output a head voltage ON signal E1022, a motor voltage ON signal E1023 and a power control signal E1024.

(1-4) Optical Sensors

The optical sensors in this embodiment use properly chosen illuminating colors according to the ink colors and the head construction employed in the printing apparatus. Suppose an LED used illuminates in a certain color. A print head that ejects an ink color with an excellent light absorbing characteristic for this LED light can be subjected to a correction operation during the dot position adjust value calculation mode.

For example, when the LED emits a red or infrared light; a black (Bk) or cyan (C) ink is preferably used from the standpoint of light absorbing characteristic For a magenta (M) or yellow (Y) ink color, it is difficult to obtain a satisfactory density characteristic or S/N ratio with the red or infrared LED.

However, if, in addition to red and infrared LEDs, a green LED and a blue LED are used, it is possible to calculate corrected values for magenta (M) and yellow (Y) inks.

Mounting a plurality of LEDs in this manner enables all ink colors to be detected. Not only does this arrangement allows dot landing positions of each color to be adjusted precisely during a bidirectional printing but it also enables dot positions to be adjusted among different colors by adjusting dot positions of each color (C, M, Y) with respect tot those of black. The kind and number of LEDs to be mounted can be set appropriately according to the printing operation to be performed. For example, if a printing apparatus capable of color printing performs a bidirectional printing with only a black ink, a red LED intended for the black need only be used.

Figure 8:
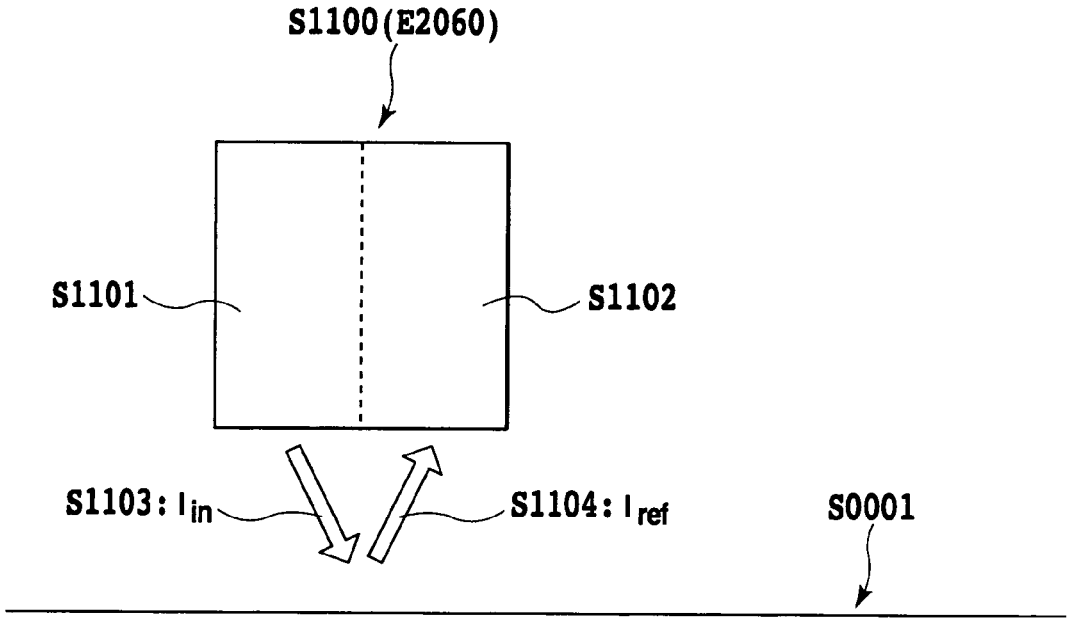
FIG. 8 is a schematic diagram showing how an optical sensor applicable to the embodiment works.

FIG. 8 schematically illustrates the structure of a reflection type optical sensor S1100 used in the printing apparatus of this embodiment. The reflection type optical sensor S1100 of this embodiment also functions effectively as the paper width sensor E2060. That is, the reflection type optical sensor S1100 of this embodiment performs a detection operation on both test patterns, one for calculating the dot position adjust value and one for the paper width detection. The reflection type optical sensor S1100 mounted on the carriage M4001 has a light emitting portion S1101 and a light receiving portion S1102 as shown. A light lin S1103 emitted from the light emitting portion S101 is reflected by a print medium S0001. The light receiving portion S1102 detects a reflected light Iref S1104. A detection signal Is sent through a flexible cable (not shown) to a control circuit formed on a printed circuit board of the printing apparatus where it is converted into a digital signal by an A/D converter. The position on the carriage M4001 where the optical sensor S1100 (E2060) is mounted is at the side surface of the carriage M4001, as shown in FIG. 2. In this case, if during the printing scan, a path along which the nozzles of the print head travels and a path along which the optical sensor S1100 moves are the same, there is a danger that the optical sensor S1100 may be contaminated with ink spray. To prevent this, this embodiment has the two paths arranged at positions slightly shifted from each other in the print medium transport direction. A sensor S1100 with a relatively low resolution may be used, which eliminates a possibility of the printing apparatus significantly rising in cost depending on the sensor resolution.

EMBODIMENT 1

A construction characteristic of this invention will be described as Embodiment 1 in the following. In an ink jet printing apparatus with an optical sensor capable of automatic dot position adjust value calculation processing, before a test pattern for calculating a dot position adjust value is printed, a width of a print medium is detected to see if the print medium is wide enough to allow for normal dot position adjust value calculation processing.

The dot position adjust value calculation processing in this example is performed to obtain adjust values that are used to 1) in a printing apparatus that performs printing by reciprocally moving a carriage for scan, align print positions between dots formed by a forward printing and a backward printing, 2) in a print head that ejects a plurality of color inks, align print positions so that different color inks can land on the same position The dot position adjust value calculation processing is also referred to as a print position alignment, a registration or a regi-adjust. In this embodiment, a print pattern consisting of a plurality of line patterns to be printed during the dot position adjust value calculation processing is called a test pattern for dot position adjustment.

Figure 9:
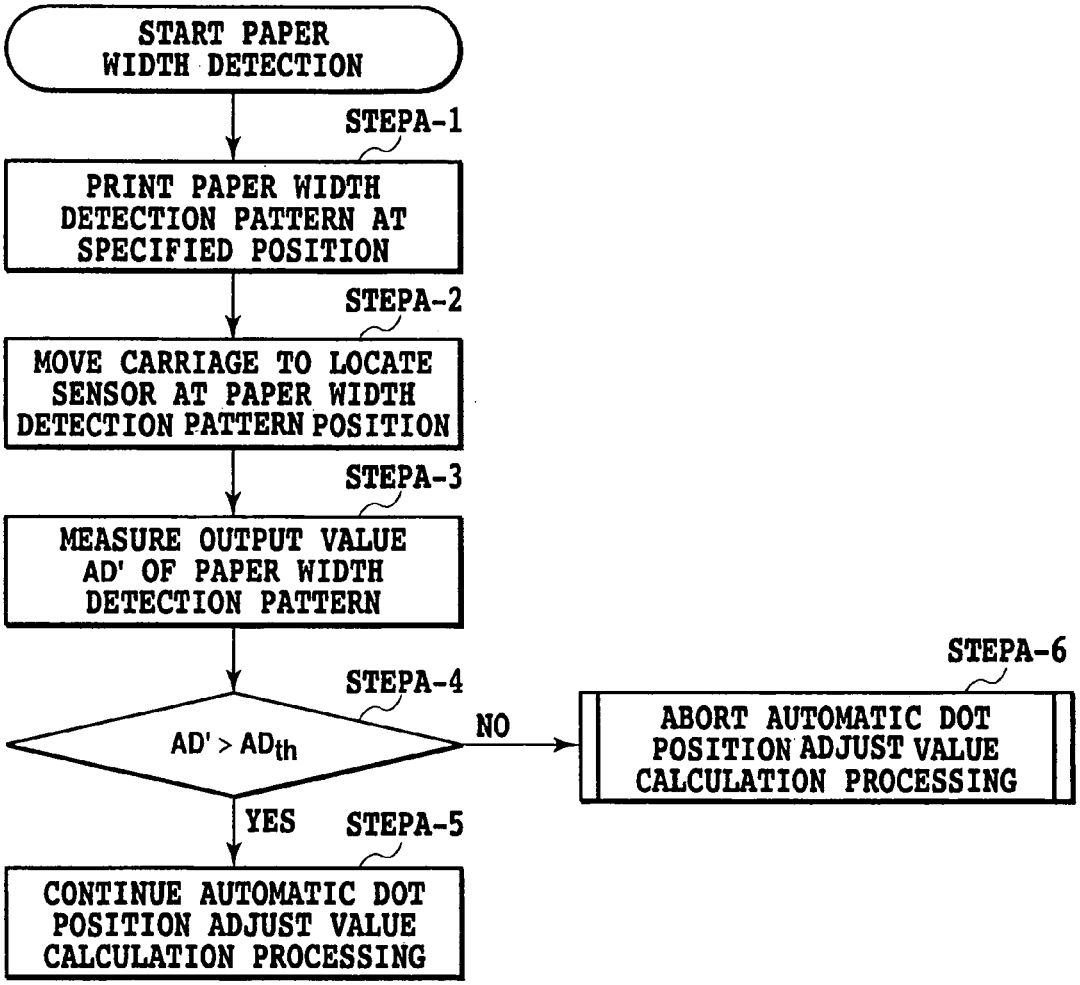
FIG. 9 is a flow chart showing a sequence of steps performed to detect a paper width in Embodiment 1 of this invention.

FIG. 9 is a flow chart describing a sequence of steps carried out by the printing apparatus to check the paper width.

First, step A-1 prints a test pattern for paper width detection on a specified position on a print medium supplied. At this time, the position where the test pattern is printed is slightly outside, in the carriage scan direction, an area in which the test pattern for dot position adjustment is printed. If the print medium is so small that the test pattern for dot position adjustment cannot be fully printed, an arrangement needs to be made to ensure that ink is ejected onto the platen. In this case, directly applying ink to the platen will contaminate the interior of the printing apparatus. So, in the printing apparatus of this embodiment, as already shown in FIG. 3 and FIG. 4, a platen absorbent is provided on the platen where the paper width detection pattern is printed. With this arrangement, when a small sized print medium is used, ink is absorbed by this platen absorbent. The test pattern need only be such as will be detected at an enough density by an optical sensor. For example, it may be a patch printed with a uniform duty.

A next step A-2 moves the carriage M4001 having the optical sensor S1100 in the main scan direction and the print medium printed with the test pattern in the sub-scan direction so that the optical sensor S1100 is situated over the paper width detection test pattern.

Figure 10:
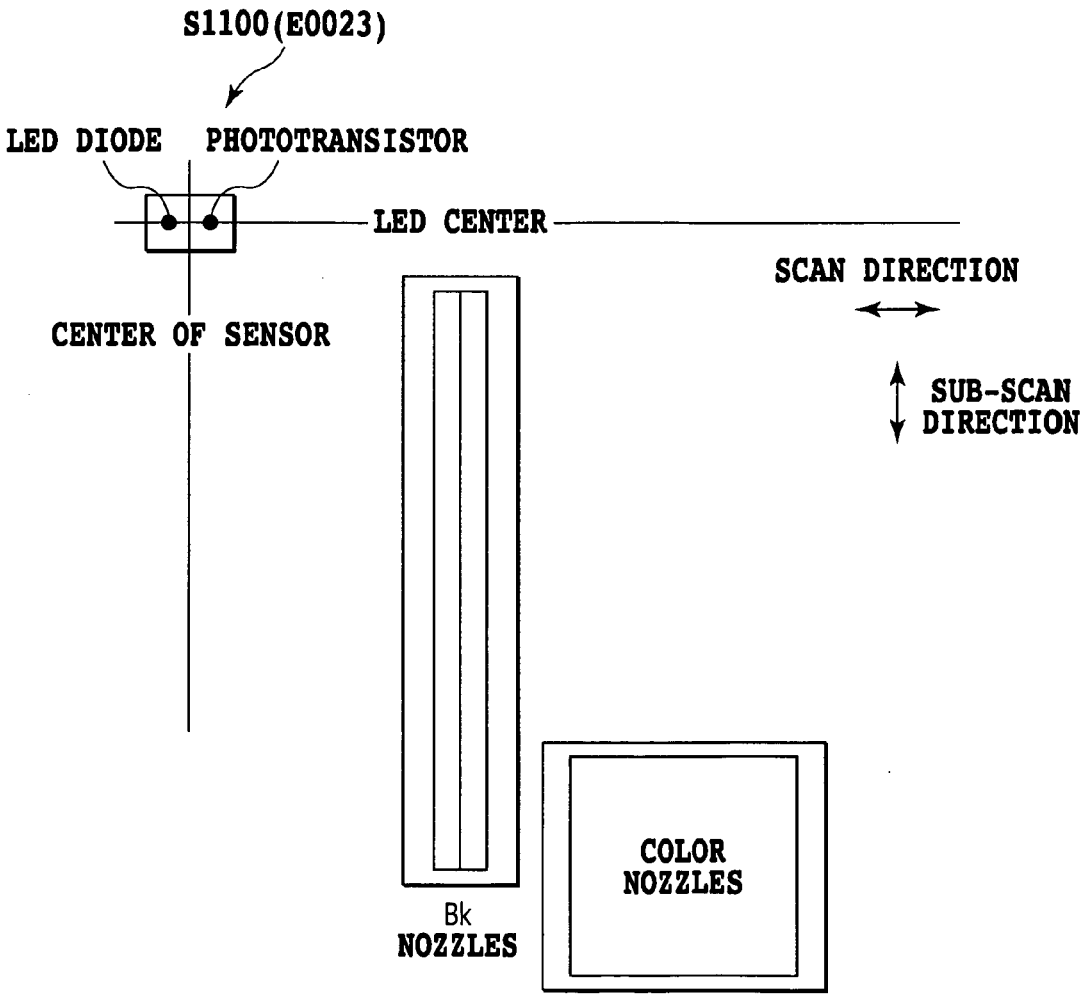
FIG. 10 is a schematic diagram showing a positional relation between an optical sensor and a print head applicable to the embodiment.

FIG. 10 shows a positional relation between the nozzles of each color and the optical sensor S1100. As shown in the figure, a position where black nozzles are arrayed, a position where color nozzles are arrayed and a position where the optical sensor S1100 is located are shifted from one another in the main scan direction and in the sub-scan direction (paper feed direction). Therefore, for the optical sensor S1100 to detect a test pattern printed by the black nozzles or color nozzles, the print medium must be advanced a predetermined distance in the sub-scan direction and held there.

A subsequent step A-3 obtains an output value AD' of the paper width detection test pattern by using the optical sensor S1100. This value is obtained by A/D-converting a detected analog signal and then subject the digitized signal to a brightness density conversion. The higher the optical density of an area detected, the larger the output value. In this embodiment the output value is assumed to be around 340 for blank paper, about 900 for a patch printed with black at 100% duty, and about 300 for the platen. A pre-adjustment is made of an LED drive duty (PWM) of the reflection type optical sensor S1100 so that these output values are obtained.

Step A-4 checks if the output value AD' obtained at step A-3 is larger than a threshold ADth. In this embodiment, the threshold ADth is set at 500. If the output value AD' is larger than the threshold ADth, it is decided that the print medium has a width large enough to print the test pattern for dot position adjustment. Then the processing moves to step A-5 where it continues the automatic dot position adjust value calculation mode. More specifically, the test pattern for dot position adjustment is printed on the print medium and then read by the reflection type optical sensor S1100. As a result, a variety of parameters for driving the print head are obtained which will result In adjusted print positions.

If the output value AD' is smaller than the threshold ADth, it is decided that the print medium is not wide enough to print the test pattern for dot position adjustment. Then, the processing moves to step A-6 where it decides that the dot position adjust value calculation processing ends in error. More specifically, the processing informs the user, before exiting, that the dot position adjust value calculation mode failed to be completed normally, by showing up a pop-up from a printer driver or illuminating an LED on the printing apparatus body.

If the paper width detection is executed according to the sequence described above and if a specified size of print medium is used in the dot position adjust value calculation mode, an optically reflected density higher than the threshold ADth can be obtained in step A-3. In other words, the ADth is so set as Ma realize the above condition. However, if a print medium smaller than the specified size is supplied, what lies directly below the optical sensor is not the paper width detection pattern but the platen, so that the reflected density higher than the threshold ADth cannot be obtained. Therefore, it is decided that a normal dot position adjust value calculation processing is not possible with the currently supplied print medium or that the print medium has failed to be supplied normally.

If a print medium smaller than the specified size is supplied, it is discharged even before the test pattern for dot position adjustment is printed on it. Thus, ink or print medium can be prevented from being wasted through printing test patterns not suited to adjustment.

In the embodiment described above, in obtaining an output value of the pattern by using an optical sensor, two or more detections may be performed on the same pattern and the resulting output values averaged to produce a final output value AD'. This can minimize errors when there are variations in measured values of the optical sensor.

As with the test pattern for dot position adjustment, the paper width detection pattern is preferably printed using an ink color which has high reflection characteristic for an optical sensor characteristic. For instance, when an optical sensor with a red LED is used, an optical reflection characteristic is very small for magenta and yellow and large for black and cyan. Some level of reflection characteristic can be obtained whichever color is used in the pattern printing. But a decision with higher reliability can be made if black that provides a higher output value is chosen.

In the process of the paper width detection, rather than detecting the presence or absence of a print medium by using an optical sensor, this embodiment prints the paper width detection test pattern on the print medium and detects it, making it possible to correctly determine whether the print medium is wide enough to print a test pattern for dot position adjustment.

While this embodiment uses the optical sensor S1100, that detects the paper width detection test pattern, also for detecting the dot position adjustment test pattern printed on the print medium, it is possible to use a separate sensor, such as a CCD camera and a line sensor, to perform the dot position adjustment.

EMBODIMENT 2

Another construction characteristic of this invention will be described as Embodiment 2 in the following. As in the first embodiment, this embodiment detects the width of a print medium to see if the print medium has an enough width to perform the automatic dot position adjust value calculation processing normally. The second embodiment, however differs from the first embodiment in that not only is an output value of the test pattern measured but an output value of the print medium before it is printed with the test pattern is also measured. A difference between the two output values is used to correctly determine whether or not the test pattern has actually been printed.

Figure 11:
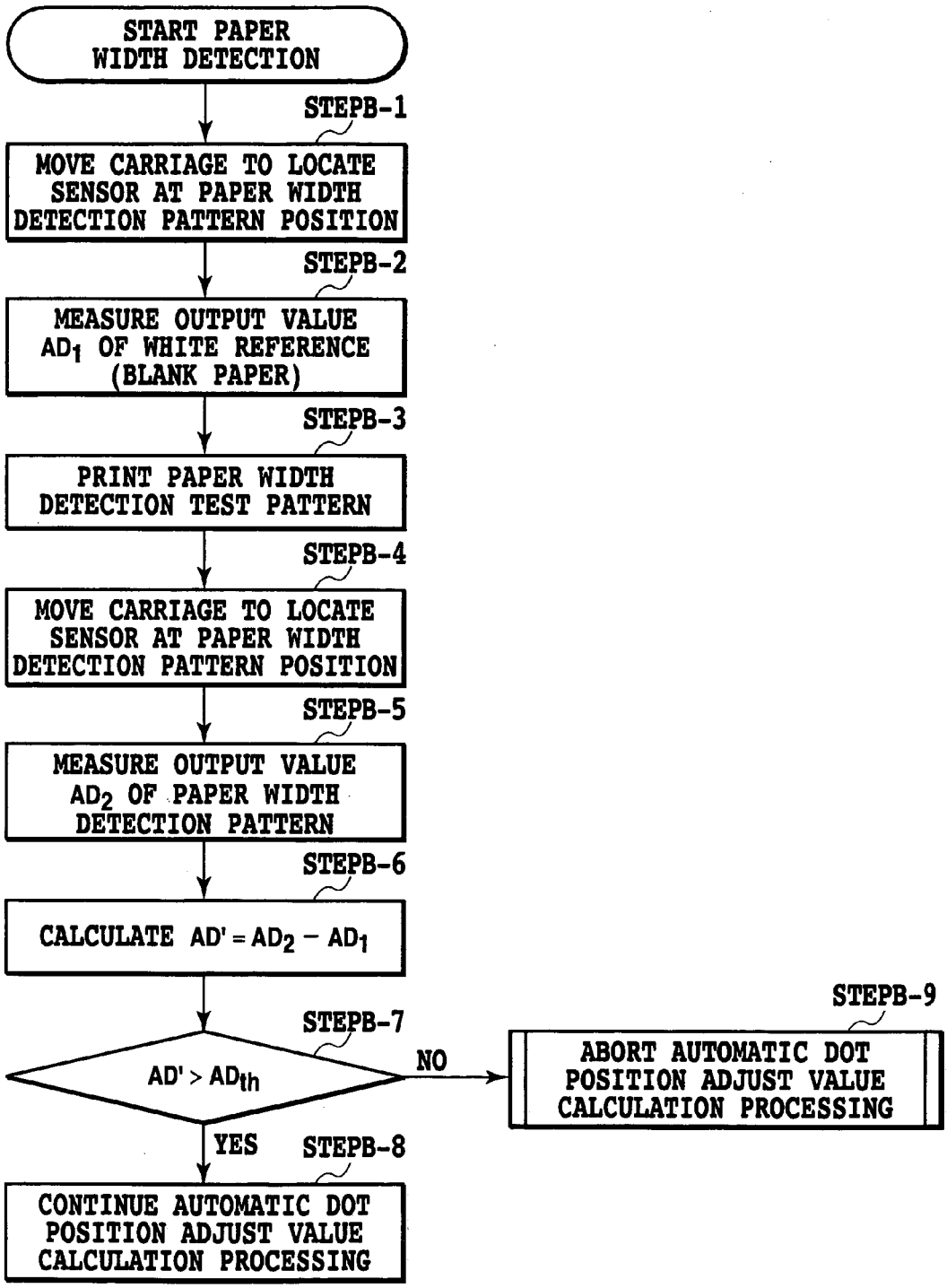
FIG. 11 is a flow chart showing a sequence of steps performed to detect a paper width in Embodiment 2 of this invention.

FIG. 11 is a flow chart showing a sequence of steps performed by the printing apparatus of this embodiment to detect a paper width.

First, step B-1 moves the carriage and the print medium so that the optical sensor S1100 is situated at a position on the print medium supplied where the paper width detection test pattern is printed.

Step B-2, using the optical sensor S1100, measures an output value AD1 for a blank print medium and takes it as a white reference.

Further, step B-3 moves the carriage and the print medium so that the paper width detection-test pattern can be printed at a position on the print medium where the optical sensor S1100 took measurement in step B-2, and then prints the paper width detection test pattern.

Step B-4 moves the carriage M4001 mounting the optical sensor S1100 in the main scan direction and the print medium printed with the paper width detection test pattern in the sub-scan direction so that the optical sensor S1100 is situated above the test pattern printed in step B-3.

Step B-5, using the optical sensor S1100, measures an output value AD2 of the paper width detection test pattern.

Step B-6 calculates a difference between the output value AD1 of the white reference obtained in step B-2 and the output value AD2 of the paper width detection test pattern obtained in step B-5, i.e., AD'=AD2−AD1.

Further, step B-7 checks if the AD' measured in step B-6 is greater than the threshold ADth of this embodiment The ADth may, for example, be set to ADth=100. The reason that the ADth value of this embodiment differs from the value ADth=500 of Embodiment 1 is that the AD' of this embodiment is not the output value itself obtained by measuring the paper width detection test pattern but is a difference between the output value obtained by measuring the paper width detection test pattern and the output value of a blank portion of the print medium before being printed with the pattern. Printing apparatus applying this invention can generally deal with a variety of kinds of print mediums and the density of the print medium itself, i.e., the measured output value of the optical sensor, often varies from one print medium to another. No matter what output value the print medium may have when it is not yet printed, the dot position adjustment pattern can be detected as long as a printed portion and an unprinted portion are clearly distinguished Therefore, in this embodiment, by making a clear distinction between the printed portion and the unprinted portion, a decision can be made as to whether the dot position adjust value calculation processing that follows can be executed or not. If step B-7 finds that the output value AD'>ADth, it can be decided that the print medium is normally printed with the paper width detection test pattern. Therefore, the processing proceeds to step B-8 where it continues the dot position adjust value calculation mode.

If the output value AD'≦ADth, it is decided that the print medium does not have an enough width to print a dot position adjustment pattern. The processing then goes to step B-9 where it aborts the dot position adjust value calculation processing. More specifically, the processing informs the user, before exiting, that the dot position adjust value calculation mode failed to be completed normally, by showing up a pop-up from a printer driver or illuminating an LED on the printing apparatus body.

If the paper width detection is executed according to the above sequence and if a specified size of print medium is used during the dot position adjust value calculation mode, a somewhat large AD' value can be obtained because the area measured changes from a white background in step B-2 to a black background in step B-5. If on the other hand a print medium smaller than the specified size is used, the output value obtained does not change before and after the pattern is printed in step B-3 because the platen lies directly below the optical sensor and the print head. Thus, for the print medium currently supplied, it can be decided that a normal dot position adjust value calculation processing is not possible or that a normal paper feeding operation has not been performed.

As in Embodiment 1, if a print medium smaller than a specified size is supplied, this embodiment discharges the print medium even before it is printed with the dot position adjustment pattern. Ink and print medium can therefore be prevented from being wasted through printing test patterns not suited to adjustment.

Further, in this embodiment since it is not affected by the density value of a white background, the dot position adjust value calculation mode can be executed in a variety of kinds of print mediums.

As in Embodiment 1, in obtaining an output value of the pattern by using an optical sensor, two or more detections may be performed on the same pattern and the resulting output values averaged to produce a final output value AD'. This can minimize errors to some extent when there are variations in measured values of the optical sensor.

In this embodiment also, the paper width detection pattern is preferably printed using an ink color which has a high reflection characteristic for an optical sensor characteristic, as with the test pattern for dot position adjustment. For instance, when an optical sensor with a red LED is used, an optical reflection characteristic is very small for magenta and yellow and large for black and cyan. Some level of reflection characteristic can be obtained whichever color is used in the pattern printing. But a decision with higher reliability can be made if black that provides a higher output value is chosen.

EMBODIMENT 3

A third embodiment of this invention will be described. In this embodiment also, the construction described in the first and second embodiments is applied. This embodiment is characterized in that, when an overall length of a plurality of nozzles in each nozzle array (a print width of a print head) is larger than a width of a platen absorbent, the paper width detection test pattern is printed by using only those nozzles situated directly above the platen absorbent.

Figure 12:
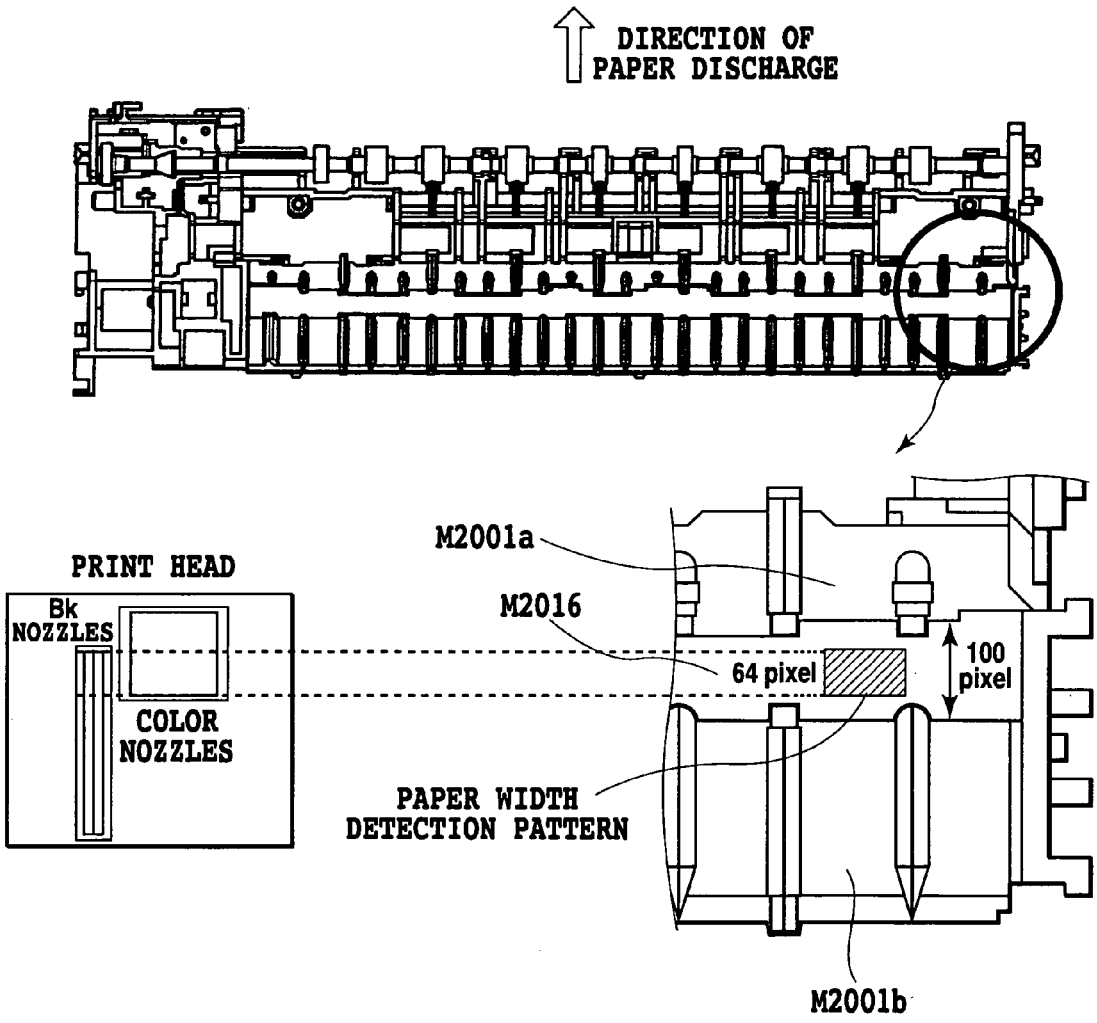
FIG. 12 is a schematic diagram showing a platen absorbent and a print position of a paper width detection pattern in Embodiment 3.

FIG. 12 schematically shows a size relation among a platen, a platen absorbent and a print head in a printing apparatus that is applicable in this embodiment. In this embodiment, the width of the platen absorbent M2016 held between the two print medium support surfaces M2001*a*, M2001*b* is set to about 100 pixels as shown. Thus, ink droplets ejected onto an area 100 pixels wide are mostly absorbed by the platen absorbent M2016 and do not contaminate the interior of the apparatus. One pixel referred to here represents an area in which one dot is printed by the print head of this embodiment. Further, the print head used in this embodiment has a print density of 600 dpi (dots/inch).

Figure 13:
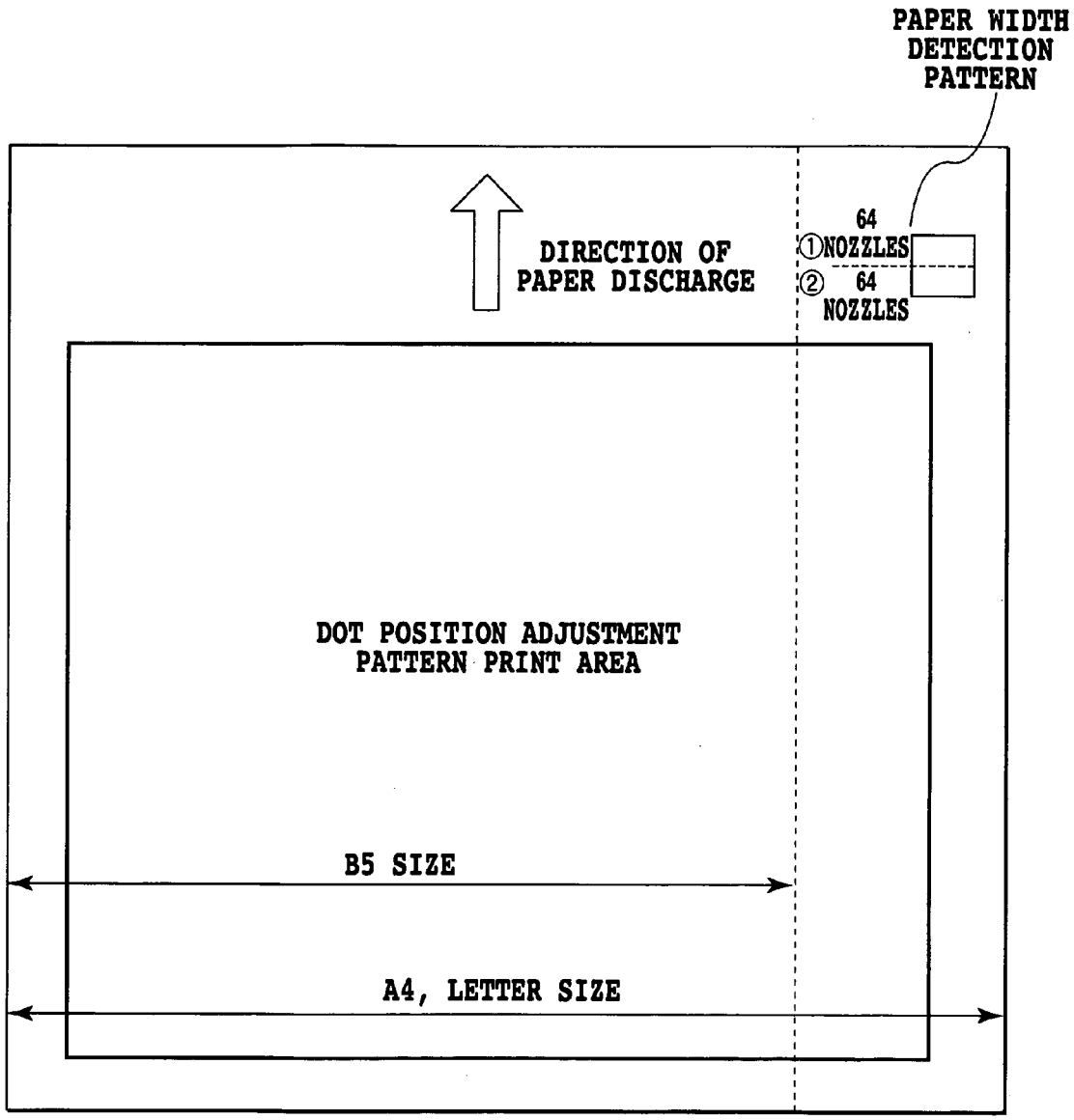
FIG. 13 is a schematic diagram showing an example arrangement of a paper width detection pattern and a dot position adjustment pattern both printed on a print medium in the embodiment when detecting the paper width.

FIG. 13 shows a positional relation in a print medium between a print area for the dot position adjustment pattern and a print area for the paper width detection test pattern. As shown in the figure, the dot position adjustment pattern can be printed on a print medium with sufficient margins if the print medium has a width almost equal to that of A4-size or letter-size paper. However, in the case of a print medium about the size of B5, the print area of the test pattern overruns an edge of the print medium. Therefore, as already explained, the paper width detection test pattern is printed slightly outside the dot position adjustment pattern, as shown. Depending on whether the paper width detection test pattern is printed normally on the print medium, it is determined whether or not the dot position adjustment pattern can be printed.

As shown in FIG. 13, in this embodiment the two kinds of test patterns are printed slightly overlapping each other in the width direction. It is noted, however, that the arrangement shown in FIG. 13 does not limit the present invention in any way. The paper width detection test pattern may be printed anywhere (e.g. including an end portion of the print area for the dot position adjustment pattern) or in any size or shape as long as it is printed upstream, in the print medium transport direction, of the dot position adjustment pattern and also, when seen in the width direction, in an area where the paper width detection test pattern could not be printed normally if the print medium used were of a size not recommended (e.g., B5 in this case).

In this embodiment, the length in the transport direction of the paper width detection test pattern to be printed is set to 128 pixels. This length of the test pattern, though it does not limit this invention or embodiment, should preferably be long enough to be detected by the optical sensor S1100 used. In this example, the pattern is set to be at least 100 pixels long.

In the configuration shown FIG. 12 and FIG. 13, it is assumed that the paper width detection test pattern 128 pixels long is printed in a single scan of the printhead. Consider a case in which a print medium supplied is a narrow one such as B5 size. In that case, of the ink droplets ejected to print the paper width detection test pattern, those for 100 pixels are absorbed by the platen absorbent M2016 but those for 28 pixels that overrun the absorbent adhere to the platen M2001, contaminating the interior of the apparatus.

To avoid this problem, this embodiment does not use those nozzles situated above the platen M2001 but only a part of those nozzles situated above the platen absorbent M2016. The test pattern is also printed in two or more scans. That is, as shown in FIG. 13, the 128-pixel pattern is printed in two scans, 64 pixels each, with the print medium transport operation performed between the two scans. In the first print scan, ink is ejected onto an area shown shaded in FIG. 12. This is followed by the print medium being transported a distance equal to 64 pixels. After this, another 64-pixel area is printed in the second scan. This arrangement ensures that all the ink droplets ejected outside the print medium are absorbed by the platen absorbent M2016 if the print medium is narrow and the test pattern overruns the print medium. Thus, the platen and the interior of the printing apparatus are not contaminated.

Although we have described an inkjet printing apparatus as an example, the present invention is not limited to this example. In addition to the ink jet printing apparatus, this invention is also effective to other types of printing apparatus as long as they are capable of printing based on a dot matrix system.

As described above, this invention checks the size of a print medium supplied before printing the dot position adjustment pattern. If the print medium supplied is smaller than a size specified for the dot position adjust value calculation processing, the print medium is discharged without printing the dot position adjustment pattern on it. This prevents the print medium from being wasted or the interior of the printing apparatus from being contaminated and assures a normal, smooth, automatic execution of the dot position adjust value calculation mode.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese. Patent Application No. 2003-308004 filed Aug. 29, 2003, which is hereby incorporated by reference herein.

What is claimed is:

1. A printing apparatus that forms an image on a print medium by printing a colorant thereon according to a dot matrix printing method using printing means having a plurality of print elements, the printing apparatus comprising:

means for printing a first test pattern;

first detection means for detecting the first test pattern;

decision means for making a decision on an execution or non-execution of a printing of a second test pattern according to a size of the print medium, based on information obtained by the detection of the first test pattern by the first detection means;

means for, when the decision means decides that the second test pattern should be printed, printing the second test pattern on the same print medium that the first test pattern is printed on; and second detection means for detecting the second test pattern.

2. A printing apparatus according to claim 1, wherein the same optical sensor comprises the first detection means and the second detection means, the same optical sensor having a light emitting portion and a light receiving portion to measure optical reflection characteristics of the first and second test patterns.

3. A printing apparatus according to claim 1, further comprising:

means for determining adjust values for print positions of dots printed by the printing means, based on information obtained by the detection of the second test pattern by the second detection means.

4. A printing apparatus according to claim 2, wherein the same optical sensor measures an output value for a blank print medium prior to detection of the first test pattern by the first detection means.

5. A printing apparatus according to claim 1, wherein the first test pattern has a narrower area than the second test pattern and, when the print medium is smaller in size than an overall area in which to print the second test pattern, the first test pattern is located at a position where it is not printed on the print medium.

6. A printing apparatus according to claim 5, wherein when the print medium is smaller in size than an overall area in which to print the second test pattern, a colorant used to print the first test pattern is absorbed by an absorbent provided in the printing apparatus.

7. A printing apparatus according to claim 6, wherein when the first test pattern is printed, only those of the plurality of print elements of the printing means, which are arranged at a position where the colorant ejected from those print elements is absorbed by the ink absorbent if the print medium is not present, are used.

8. A printing apparatus according to claim 7, further comprising:

main scan means for reciprocally moving the printing means in a main scan direction; and sub-scan means for moving the print medium in a sub-scan direction relative to the print means, wherein the first test pattern is printed by repetitively alternating a main scan printing operation and a print medium feeding operation to move the printing means two or more times by the main scan means, the main scan printing operation scanning the printing means by the main scan means and at the same time activating predetermined print elements of the printing means, the print medium feeding operation feeding, by the sub-scan means, the print medium a distance corresponding to a print area of the predetermined print elements relative to the printing means.

9. A printing apparatus according to claim 3, wherein the adjust values for print positions of dots printed by the printing means, which are determined based on information obtained by the second detection means, are adjust values for dot positions in the dot matrix printing method.

10. A dot position adjusting method using a detection means to detect a pattern printed on a print medium and designed to form an image on the print medium by printing a colorant thereon according to a dot matrix printing method using a printing means having a plurality of print elements, the dot position adjusting method comprising:

a step of printing a first test pattern;

a first detection step of detecting the first test pattern by the detection means;

a decision step of making a decision on an execution or non-execution of a printing of a second test pattern according to a size of the print medium, based on information obtained by the first detection step;

a step of, when the decision step decides that the second test pattern should be printed, printing the second test pattern on the same print medium that the first test pattern is printed on;

a second detection step of detecting the second test pattern by the detection means; and a step of determining adjust values for print positions of dots printed by the dot matrix printing method, based on information obtained by the second detection step.

11. A printing method forming an image on a print medium using printing means having a plurality of print elements, the printing method comprising:

a step of printing a first test pattern on the print medium;

a first detection step of detecting the first test pattern printed on the print medium by first detecting means;

a decision step of deciding an execution or non-execution of a printing of a second test pattern according to a size of the print medium, based on information obtained by the first detection step; and a step of printing the second test pattern on the same print medium when determined that the second test pattern should be printed.

* * * * *

UNITED STATES PATENT AND TRADEMARK OFFICE

CERTIFICATE OF CORRECTION

PATENT NO. : 7,114,790 B2
APPLICATION NO. : 10/925036
DATED : October 3, 2006
INVENTOR(S) : Seki et al.

It is certified that error appears in the above-identified patent and that said Letters Patent is hereby corrected as shown below:

COLUMN 1
Line 38, “examples” should read --example,--.

COLUMN 4
Line 6, “jet-system” should read --jet system--.
Line 10, “embodiment” should read --embodiment.--.
Line 60, “reads” should read --ready--.

COLUMN 5
Line 11, “a” (second occurrence) should read --automatic--.
Line 53, “action” should read --action.--.

COLUMN 7
Line 57, “rotatable” should read --rotatably--.
Line 58, “rotatable” should read --rotatably--.
Line 67, “It” should read --it--.

COLUMN 8
Line 24, “toga” should read --to a--.
Line 62, “M4001” should read --M4001.--.

COLUMN 9
Line 17, “rubber” should read --rubber.--.
Line 43, “like,” should read --like.--.
Line 57, “scanning” should read --scanning.--.

COLUMN 10
Line 30, “tie” should read --the--.

COLUMN 11
Line 25, “E0011” should read --E0011.--.
Line 52, “cable B1031” should read --cable E1031--.

COLUMN 12
Line 23, “CPU E100” should read --CPU E1001--.
Line 55, “Interrupt” should read --interrupt--.

UNITED STATES PATENT AND TRADEMARK OFFICE

CERTIFICATE OF CORRECTION

PATENT NO. : 7,114,790 B2
APPLICATION NO. : 10/925036
DATED : October 3, 2006
INVENTOR(S) : Seki et al.

It is certified that error appears in the above-identified patent and that said Letters Patent is hereby corrected as shown below:

COLUMN 13
Line 2, “92004” should read --E2004--.
Line 22, “data” should read --data from--.
Line 29, “USB I/F” (first occurrence) should read --USB I/F.--.
Line 51, “B2041” should read --E2041--.

COLUMN 14
Line 39, “DMA” should read --DMA.--.
Line 51, “E100l” should read --E1001.--.

COLUMN 15
Line 7, “DMA’s uses” should read --DMAs use--.
Line 27, “characteristic” should read --characteristic.--.
Line 36, “allows” should read --allow--.
Line 56, “lin” should read --Iin--.
Line 57, “S101” should read --S1101--.
Line 59, “Is” should read --is--.

COLUMN 16
Line 27, “position” (first occurrence) should read --position.--.

COLUMN 17
Line 26, “In” should read --in--.
Line 42, “Ma” should read --to--.

COLUMN 18
Line 2, “obtained” should read --obtained for--.
Line 24, “an” should be deleted.
Line 44, “detection-test” should read --detection test--.
Line 60, “embodiment” should read --embodiment.--.

COLUMN 19
Line 9, “embodiment” should read --embodiment.--, and “distinguished” should read --distinguished.--.
Line 21, “an” should be deleted.
Line 67, “obtained” should read --obtained for--.

COLUMN 20
Line 62, “shown” should read --shown in--.

UNITED STATES PATENT AND TRADEMARK OFFICE

CERTIFICATE OF CORRECTION

PATENT NO. : 7,114,790 B2
APPLICATION NO. : 10/925036
DATED : October 3, 2006
INVENTOR(S) : Seki et al.

It is certified that error appears in the above-identified patent and that said Letters Patent is hereby corrected as shown below:

COLUMN 21
Line 45, "Japanese." should read --Japanese--.

COLUMN 22
Line 56, "a" should be deleted.
Line 60, "a" (first occurrence) should be deleted.

Signed and Sealed this

Ninth Day of September, 2008

JON W. DUDAS
*Director of the United States Patent and Trademark Office*